US010849387B2

(12) United States Patent
Bruce et al.

(10) Patent No.: US 10,849,387 B2
(45) Date of Patent: Dec. 1, 2020

(54) SOLE STRUCTURES AND ARTICLES OF FOOTWEAR HAVING PLATE MODERATED FLUID-FILLED BLADDERS AND/OR FOAM TYPE IMPACT FORCE ATTENUATION MEMBERS

(71) Applicant: NIKE, Inc., Beaverton, OR (US)

(72) Inventors: Robert M. Bruce, Portland, OR (US); Joshua P. Heard, Happy Valley, OR (US); Shane S. Kohatsu, Portland, OR (US); Matthew A. Nurse, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 1193 days.

(21) Appl. No.: 13/623,660

(22) Filed: Sep. 20, 2012

(65) Prior Publication Data

US 2014/0075777 A1 Mar. 20, 2014

(51) Int. Cl.
*A43B 13/20* (2006.01)
*A43B 13/16* (2006.01)
(Continued)

(52) U.S. Cl.
CPC ..... *A43B 13/20* (2013.01); *A43B 7/144* (2013.01); *A43B 7/148* (2013.01); *A43B 7/1425* (2013.01);
(Continued)

(58) Field of Classification Search
CPC ..... A43B 13/20; A43B 13/38; A43B 13/16; A43B 13/181; A43B 13/187;
(Continued)

(56) References Cited

U.S. PATENT DOCUMENTS 795,502 A * 7/1905 Gareau ..... 36/3 B
1,011,460 A 12/1911 Maddocks
(Continued)

FOREIGN PATENT DOCUMENTS

CN 1871965 A 12/2006
CN 101005773 A 7/2007
(Continued)

OTHER PUBLICATIONS

International Searching Authority, "International Search Report & Written Opinion," issued in connection with corresponding international application No. PCT/US2013/059241, dated Dec. 20, 2013, 14 pages.
(Continued)

*Primary Examiner* — Katharine Gracz
(74) *Attorney, Agent, or Firm* — Banner & Witcoff, Ltd.

(57) ABSTRACT

Sole structures for articles of footwear, including athletic footwear, include: (a) an outsole component; (b) a midsole component engaged with the outsole component, wherein the midsole component includes at least one opening or receptacle; (c) at least one fluid-filled bladder system or foam system provided in the opening or receptacle; and/or (d) a rigid plate system including one or more rigid plates overlaying the fluid-filled bladder or foam system(s). The rigid plate(s) may be fixed directly to the midsole component or the rigid plate(s) may rest on the fluid-filled bladder(s) or foam somewhat above the surface of the midsole component when the sole structure is in an uncompressed condition. Articles of footwear and methods of making sole structures and articles of footwear including such sole structures also are described.

20 Claims, 23 Drawing Sheets

(51) Int. Cl.
*A43B 7/14* (2006.01)
*A43B 13/18* (2006.01)
*A43B 13/38* (2006.01)

(52) U.S. Cl.
CPC ..... *A43B 7/1435* (2013.01); *A43B 7/1445* (2013.01); *A43B 13/16* (2013.01); *A43B 13/181* (2013.01); *A43B 13/187* (2013.01); *A43B 13/38* (2013.01); *A43B 13/383* (2013.01)

(58) Field of Classification Search
CPC ... A43B 13/383; A43B 7/1435; A43B 7/1445; A43B 7/148; A43B 7/1425; A43B 7/144; A43B 7/088; A43B 7/087
USPC ..... 36/28, 29, 27, 35 R, 35 B
See application file for complete search history.

(56) References Cited

U.S. PATENT DOCUMENTS 1,051,880 A 2/1913 Glenn
1,059,543 A 4/1913 Kelley
1,114,685 A 10/1914 Freeman
1,823,445 A 9/1931 Goldstone
3,253,355 A 5/1966 Menken
4,316,332 A * 2/1982 Giese et al. ..... 36/28
4,316,335 A * 2/1982 Giese et al. ..... 36/129
4,404,757 A 9/1983 Sweeny
4,546,555 A 10/1985 Spademan
4,592,153 A 6/1986 Jacinto
4,638,575 A 1/1987 Illustrato
4,680,876 A 7/1987 Peng
4,702,255 A * 10/1987 Schenkl ..... A43B 7/141 36/145
4,779,359 A 10/1988 Famolare, Jr.
4,910,884 A * 3/1990 Lindh et al. ..... 36/28
4,918,838 A * 4/1990 Chang ..... 36/28
5,083,361 A 1/1992 Rudy
5,282,325 A 2/1994 Beyl
5,381,608 A 1/1995 Claveria
5,528,842 A 6/1996 Ricci et al.
5,771,606 A * 6/1998 Litchfield ..... A43B 13/20 36/28
5,852,887 A 12/1998 Healy et al.
5,915,819 A 6/1999 Gooding
6,018,889 A 2/2000 Friton
6,082,024 A * 7/2000 Del Biondi ..... 36/28
6,115,942 A 9/2000 Paradis
6,176,025 B1 1/2001 Patterson et al.
6,233,846 B1 5/2001 Sordi
6,345,455 B1 * 2/2002 Greer, Jr. ..... A61F 5/14 36/145
6,385,864 B1 5/2002 Sell, Jr. et al.
6,393,731 B1 5/2002 Moua et al.
6,497,057 B1 12/2002 Lee et al.
6,502,330 B1 1/2003 David et al.
6,550,160 B2 4/2003 Miller, II
6,571,490 B2 6/2003 Tawney et al.
6,910,287 B2 6/2005 Truelsen
6,920,707 B1 7/2005 Greene et al.
6,968,637 B1 11/2005 Johnson
7,020,988 B1 4/2006 Holden et al.
7,152,343 B2 12/2006 Whatley
7,243,443 B2 7/2007 Swigart
7,386,946 B2 6/2008 Goodwin
7,523,566 B2 4/2009 Young-Chul
7,533,477 B2 5/2009 Goodwin et al.
7,578,077 B2 8/2009 Marc
7,752,775 B2 7/2010 Lyden
7,788,824 B2 * 9/2010 Hann ..... 36/27
7,832,118 B2 11/2010 Holden et al.
7,921,580 B2 4/2011 Russell
7,954,257 B2 * 6/2011 Banik ..... A43B 7/144 36/28
8,056,261 B2 11/2011 Nakano et al.
8,074,377 B2 12/2011 Nishiwaki et al.
2002/0170203 A1 11/2002 Sanner
2004/0098882 A1 5/2004 Tuan
2005/0000115 A1 1/2005 Kimura et al.
2005/0268488 A1 * 12/2005 Hann ..... 36/27
2005/0268490 A1 12/2005 Foxen
2005/0283999 A1 * 12/2005 Whatley ..... 36/29
2006/0021251 A1 2/2006 Swigart et al.
2006/0168847 A1 8/2006 Myers et al.
2006/0230636 A1 10/2006 Kokstis et al.
2006/0236564 A1 * 10/2006 Allard ..... A61F 5/14 36/140
2007/0028484 A1 2/2007 Akhidime
2007/0107264 A1 5/2007 Meschter et al.
2007/0186445 A1 * 8/2007 Gratadour et al. ..... 36/28
2007/0277401 A1 12/2007 Young-Chul
2008/0086916 A1 4/2008 Ellis
2008/0196272 A1 * 8/2008 Hay ..... A43B 7/1415 36/88
2008/0263899 A1 10/2008 Lee
2009/0090025 A1 4/2009 Cassiday et al.
2009/0126230 A1 5/2009 McDonald et al.
2009/0183393 A1 7/2009 Lee
2009/0235557 A1 9/2009 Christensen et al.
2010/0018077 A1 * 1/2010 Marone ..... A43B 7/223 36/91
2010/0107444 A1 * 5/2010 Aveni et al. ..... 36/88
2010/0107445 A1 * 5/2010 Aveni ..... A43B 13/189 36/92
2010/0146818 A1 6/2010 Sokolowski
2010/0251565 A1 10/2010 Litchfield et al.
2011/0005099 A1 1/2011 Aveni et al.
2011/0035966 A1 2/2011 Geer et al.
2011/0203137 A1 8/2011 Long et al.
2011/0271553 A1 11/2011 McCarron
2012/0023784 A1 2/2012 Goldston et al.

FOREIGN PATENT DOCUMENTS

CN 102202536 A 9/2011
DE 102006025990 A1 12/2006
EP 1346655 A1 9/2003
JP S64-43201 A 2/1989
JP H07-8304 A 1/1995
JP H11-506027 A 6/1999
JP 3063703 U 11/1999
JP 2006-334400 A 12/2006
JP 2007089734 A 4/2007
JP 2008501487 A 1/2008
JP 2009-165814 A 7/2009
WO 9736508 A1 10/1997
WO 2005120275 A2 12/2005
WO 2006127427 A2 11/2006
WO 2007024523 A1 3/2007

OTHER PUBLICATIONS

Oct. 23, 2015—(CN) Office Action App. 201380048752.9.
Oct. 9, 2015—(CN) Office Action—App 2013800487938.
Final Rejection dated Jul. 17, 2015 U.S. Appl. No. 13/623,722.
International Search Report and Written Opinion dated Jan. 3, 2014 in PCT/US2013/058986.
International Serach Report and Written Opinion in International Patent Applcation No. PCT/US2103/059268 dated Dec. 20, 2013.
Non Final Office Action dated Oct. 2, 2015 in U.S. Appl. No. 13/623,701.
Feb. 6, 2016 (AU)—Patent Examination Report App. No. 2013318445.
Feb. 15, 2016 (JP)—Notice of Reasons for Rejection—App 2015-533110 (with English translation).
Feb. 26, 2016 (CA)—Office Action—App. 2,885,042.
Feb. 6, 2016—(AU) Office Action—App 2013318383.
Mar. 30, 2016—(JP) Office Action—App 2015-533108 (with English translation).
Mar. 16, 2016—(CA) Office Action—App 2,883,530.
Mar. 23, 2016 (JP)—Office Action—App 2015-533104 (with English translation).

(56) References Cited

OTHER PUBLICATIONS

Sep. 22, 2016—(KR) Office Action—App 10-2015-7009944.
European Search Report. Application No. 16185002.9 dated Dec. 6, 2016.

* cited by examiner

SOLE STRUCTURES AND ARTICLES OF FOOTWEAR HAVING PLATE MODERATED FLUID-FILLED BLADDERS AND/OR FOAM TYPE IMPACT FORCE ATTENUATION MEMBERS

FIELD OF THE INVENTION

The present invention relates to the field of footwear. More specifically, aspects of the present invention pertain to sole structures and/or articles of footwear (e.g., athletic footwear) that include rigid plate(s) overlying fluid-filled bladder type and/or foam type impact-attenuating elements.

BACKGROUND

Conventional articles of athletic footwear include two primary elements, namely, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure may provide traction and control potentially harmful foot motion, such as over pronation. The general features and configuration of the upper and the sole structure are discussed in greater detail below.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces), and the upper also may include a heel counter to limit or control movement of the heel.

The sole structure generally incorporates multiple layers that are conventionally referred to as an insole, a midsole, and an outsole. The insole (which also may constitute a sock liner) is a thin member located within the upper and adjacent the plantar (lower) surface of the foot to enhance footwear comfort, e.g., to wick away moisture and provide a soft, comfortable feel. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

Despite the various available footwear models and characteristics, new footwear models and constructions continue to develop and are a welcome advance in the art.

SUMMARY OF THE INVENTION

This Summary provides an introduction to some general concepts relating to this invention in a simplified form that are further described below in the Detailed Description. This Summary is not intended to identify key features or essential features of the invention.

While potentially useful for any desired types or styles of shoes, aspects of this invention may be of particular interest for sole structures of articles of athletic footwear that include basketball shoes, running shoes, cross-training shoes, cleated shoes, tennis shoes, golf shoes, etc.

More specific aspects of this invention relate to sole structures for articles of footwear that include one or more of the following: (a) an outsole component including an exterior major surface and an interior major surface; (b) a midsole component engaged with the interior major surface of the outsole component, wherein the midsole component includes at least one opening or receptacle; (c) at least one fluid-filled bladder system or foam member provided in the opening(s) or receptacle(s); and/or (d) a rigid plate system including one or more rigid plates overlaying the fluid-filled bladder system(s) or foam member(s). The rigid plate(s) may be fixed directly to the midsole component or the rigid plate(s) may rest on the fluid-filled bladder(s) or foam member(s), optionally somewhat above a surface of the midsole component when the sole structure is in an uncompressed condition.

Other sole structures in accordance with some aspects of this invention may include one or more of the following: (a) an outsole component; (b) a midsole component including one or more midsole parts engaged with an interior major surface of the outsole component, wherein the midsole component includes an opening or receptacle defined therein, and wherein a surface of the midsole component adjacent the opening or receptacle includes an undercut area that defines a gap, e.g., between at least a portion of the bottom surface of the midsole component and the interior major surface of the outsole component; (c) a fluid-filled bladder system or a foam member located at least partially within the opening or receptacle; and (d) a rigid plate system at least partially overlaying the fluid-filled bladder system or foam member. A compressive force applied between the rigid plate system and an exterior major surface of the outsole component causes the undercut(s) and/or gap(s) to reduce in height.

Other sole structures in accordance with some examples of this invention may include one or more of the following: (a) an outsole component including an exterior major surface and an interior major surface; (b) a midsole component engaged with the interior major surface of the outsole component, wherein the midsole component includes a receptacle defined therein; (c) a fluid-filled bladder system or foam member located at least partially within the receptacle; and/or (d) a rigid plate member at least partially overlaying the fluid-filled bladder system or foam member, wherein a bottom surface of the rigid plate member is exposed and forms a bottom surface of the sole structure in an arch area of the sole structure.

Additional aspects of this invention relate to articles of footwear including uppers and sole structures of the various types described above engaged with the upper. Still additional aspects of this invention relate to methods for making sole structures and/or articles of footwear of the various types described above (and described in more detail below). More specific aspects of this invention will be described in more detail below.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
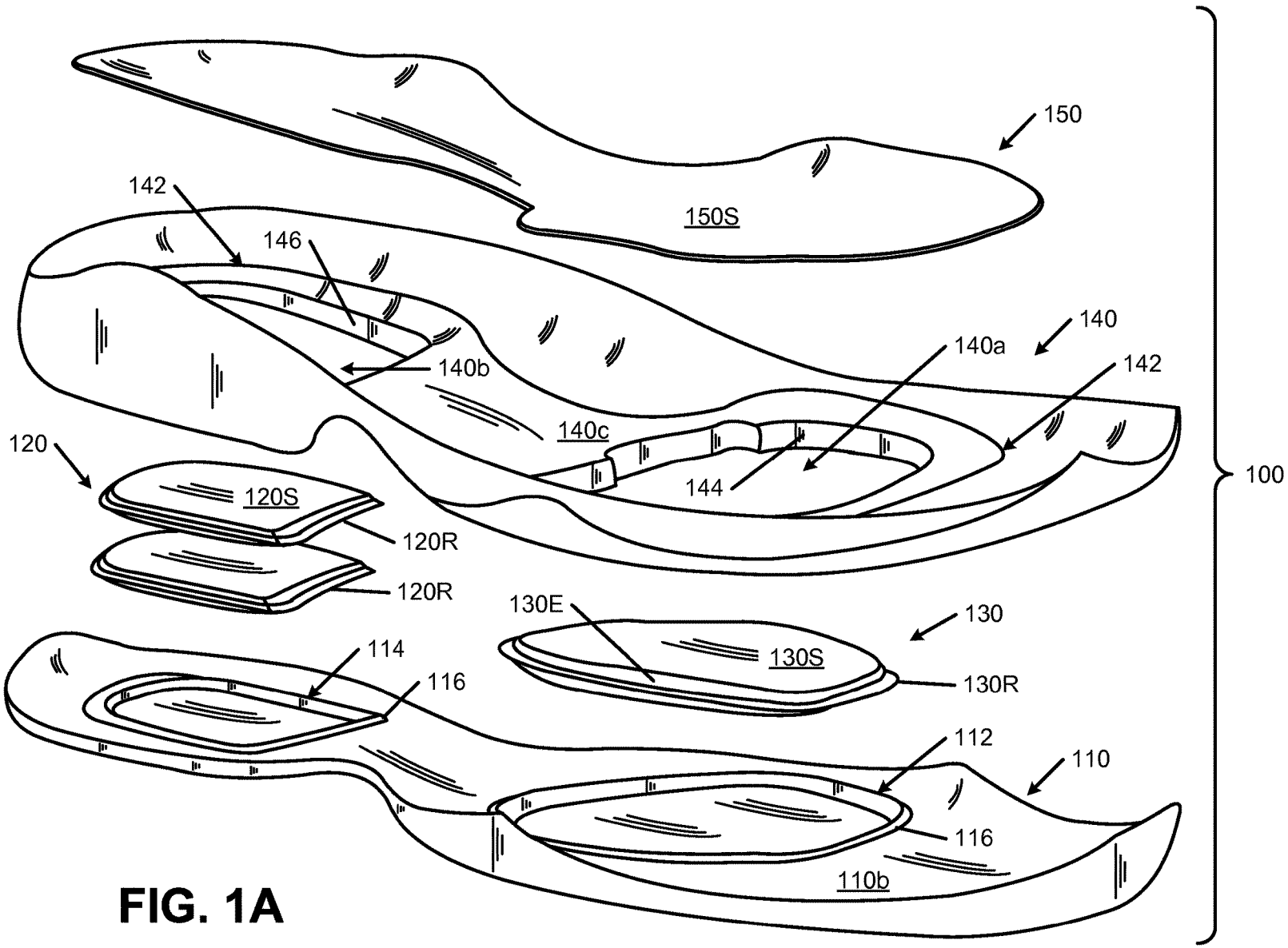
FIGS. 1A through 1J show various views of sole structures and/or components thereof according to some examples of this invention.

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and methods without departing from the scope of the present invention.

I. General Description of Aspects of this Invention

Aspects of this invention relate to sole structures and/or articles of footwear (e.g., athletic footwear) that include rigid plate(s) overlying fluid-filled bladder type and/or foam type impact-attenuating elements. More specific features and aspects of this invention will be described in more detail below.

A. Features of Sole Structures and Articles of Footwear According to Examples of this Invention Some aspects of this invention relate to sole structures for articles of footwear and articles of footwear (or other foot-receiving devices), including athletic footwear, having such sole structures. Sole structures for articles of footwear according to at least some examples of this invention may include one or more of the following: (a) an outsole component including an exterior major surface and an interior major surface, wherein the exterior major surface includes at least one projection area (e.g., a forefoot projection area and/or a rearfoot projection area), wherein the projection area(s) is (are) at least partially surrounded by and project(s) beyond a main outsole surface area, wherein the projection area(s) may be connected to the main outsole surface area by a flexible web member (e.g., around at least a portion of a perimeter of the projection area(s)); (b) a midsole component engaged with the interior major surface of the outsole component, wherein the midsole component includes at least one opening or receptacle located proximate to the projection area(s); (c) at least one fluid-filled bladder system and/or foam member engaged with the interior major surface of the outsole component or the receptacle above the projection area; and/or (d) a rigid plate system including one or more rigid plate portions at least partially overlaying the fluid-filled bladder system(s).

The rigid plate system may include a single plate covering multiple (e.g., forefoot and rearfoot) fluid-filled bladders and/or foam members or multiple, separate plates without departing from this invention. The plate(s) may include other structural features as well. For example, if desired, forefoot rigid plate portions may include a groove that separates a first metatarsal and/or big toe support region from one or more of the other metatarsal support regions (e.g., at least from a fifth metatarsal support region). This feature can help provide a more natural feel for the shoe as the medial side of the foot can flex somewhat with respect to the lateral side of the foot (which allows a more natural feel and/or motion during pronation and toe off during a step or jump). Additionally or alternatively, the rear heel area of rearfoot plate portions may include a groove that likewise allows the medial side of the foot to flex somewhat with respect to the lateral side. The rigid plates also may be curved in the heel-to-toe direction and/or the medial side-to-lateral side direction, e.g., to function as a spring and/or to provide rebound or return energy and/or to cup, couple, or otherwise support the sides of the foot.

The fluid-filled bladder systems may take on a variety of constructions without departing from this invention, including conventional constructions as are known and used in this art. If desired, each fluid-filled bladder system may constitute a single fluid-filled bladder. Alternatively, if desired, one or more of the fluid-filled bladder systems may constitute two or more fluid-filled bladders located within their respective openings and/or receptacle areas (e.g., two or more stacked fluid-filled bladders). The fluid-filled bladders may include a sealed envelope or outer barrier layer filled with a gas under ambient or elevated pressure. The bladder(s) may include internal structures (e.g., tensile elements) and/or interior fused or welded bonds (e.g., top surface to bottom surface bonds) to control the exterior shape of the bladder.

In some example structures in accordance with this invention, the main outsole surface area(s) will completely surround the projection area at which they are located. Additionally or alternatively, in some structures according to this invention, the opening(s) and/or receptacle(s) of the midsole component will completely surround the recessed area(s) of the outsole component and/or the fluid-filled bladder system(s) (or foam member(s)) mounted therein.

Sole structures in accordance with other examples of this invention may include one or more of the following: (a) an outsole component including an exterior major surface and an interior major surface; (b) a midsole component engaged with the interior major surface of the outsole component, wherein the midsole component includes one or more receptacles and one or more base surfaces at least partially surrounding the receptacle(s); (c) one or more fluid-filled bladder systems and/or foam members received in the receptacle(s), wherein an upper surface of the fluid-filled bladder system or foam member extends above the base surface of the midsole component when the sole structure is in an uncompressed condition; and/or (d) one or more rigid plate components (e.g., of the types described above) having a major surface overlying the upper surface of the fluid-filled bladder system or foam member, wherein the major surface of the rigid plate component does not contact the base surface of the midsole component when the sole structure is in an uncompressed condition. The rigid plate component(s) may include perimeter edges that extend over the respective base surface(s) of the midsole component such that the base surface of the midsole component acts as a backstop for slowing or stopping downward motion of the rigid plate component(s) during compression of the sole structure.

Still additional sole structures in accordance with some aspects of this invention may include one or more of the following: (a) an outsole component including an exterior major surface and an interior major surface; (b) a midsole component including one or more midsole parts engaged with the interior major surface of the outsole component, wherein the midsole component includes a forefoot opening and/or a rearfoot opening, and wherein:

(i) a bottom surface of the midsole component adjacent the forefoot opening includes a first undercut area that defines a first gap between at least a portion of the bottom surface of the midsole component and the interior major surface of the outsole component, and/or (ii) the bottom surface of the midsole component adjacent the rearfoot opening includes a second undercut area that defines a second gap between at least a portion of the bottom surface of the midsole component and the interior major surface of the outsole component;

(c) a forefoot fluid-filled bladder system or a foam member located at least partially within the forefoot opening and optionally engaged with the interior major surface of the outsole component; (d) a rearfoot fluid-filled bladder system or foam member located at least partially within the rearfoot opening and optionally engaged with the interior major surface of the outsole component; and (e) a rigid plate system including a first rigid plate portion at least partially overlaying the forefoot fluid-filled bladder system or foam member and/or a second rigid plate portion at least partially overlaying the rearfoot fluid-filled bladder system or foam member. A compressive force applied between the rigid plate system and the exterior major surface of the outsole component causes the first and/or second gaps to reduce in height. If desired, sole structures in accordance with some examples of this aspect of the invention may include only the forefoot midsole and outsole structures (with the rigid plate extending over only those structures) or only the rearfoot midsole and outsole structures (with the rigid plate extending over only those structures).

The undercut area(s) and/or the gap(s) between the bottom of the midsole and the interior major surface of the outsole component may extend completely around the perimeter of the opening or receptacle in which they are located, although, if desired, the undercut area(s) and/or gap(s) may be discontinuous (e.g., extend partially around the perimeter of their respective openings or receptacles). These undercut area(s) and/or gap(s) may have a maximum height within a range of 1 to 15 mm when the sole structure is in an uncompressed condition, and in some examples, a maximum height of 1.5 to 12 mm or even 1.75 to 10 mm when the sole structure is in an uncompressed condition.

Other example sole structures in accordance with some examples of this invention may include one or more of the following: (a) a forefoot outsole component including an exterior major surface and an interior major surface; (b) a rearfoot outsole component separate from the forefoot outsole component, the rearfoot outsole component including an exterior major surface and an interior major surface; (c) a forefoot midsole component engaged with the interior major surface of the forefoot outsole component, wherein the forefoot midsole component includes a forefoot receptacle defined therein; (d) a rearfoot midsole component separate from the forefoot outsole component and engaged with the interior major surface of the rearfoot outsole component, wherein the rearfoot midsole component includes a rearfoot receptacle defined therein; (e) a forefoot fluid-filled bladder system or foam member located at least partially within the forefoot receptacle; (f) a rearfoot fluid-filled bladder system or foam member located at least partially within the rearfoot receptacle; and/or (g) a rigid plate member including a first rigid plate portion at least partially overlaying the forefoot fluid-filled bladder system or foam member and/or a second rigid plate portion at least partially overlaying the rearfoot fluid-filled bladder system or foam member. A bottom surface of the rigid plate member of this example structure is exposed and forms a bottom surface of the sole structure in an arch area of the sole structure, e.g., between the forefoot outsole component and the rearfoot outsole component. If desired, sole structures in accordance with some examples of this aspect of the invention may include only the forefoot midsole and outsole components (with the rigid plate extending over only those components) or only the rearfoot midsole and outsole components (with the rigid plate extending over only those components).

The receptacles (e.g., forefoot and/or rearfoot receptacles) may extend completely or partly through an overall thickness of the midsole component. When these receptacles constitute openings that extend completely through the midsole component, the fluid-filled bladder system(s) and/or foam member(s) provided in the receptacles may be mounted directly on the interior major surface of the outsole component and within the openings. The lower surface(s) of the rigid plate component(s) may be fixed to the upper surface(s) of the fluid-filled bladder system(s) and/or foam member(s), e.g., by cements or adhesives. The rigid plate component(s) need not be fixed to the midsole component in at least some example constructions according to this aspect of the invention.

Sole structures of the types described above may include further features that help engage the fluid-filled bladders and/or foam members and maintain the desired position of the various elements in the sole structure. For example, if desired, the interior major surface of the outsole component may include one or more recessed areas and the receptacle(s) may include openings that at least partially surround the recessed area(s) of the outsole component. The recessed areas may correspond to (e.g., be located over) projection areas in the exterior major surface of the outsole component, as described above. The fluid-filled bladder(s) and/or foam member(s) may be mounted within the recessed areas of the outsole component.

Still additional aspects of this invention relate to articles of footwear including uppers (e.g., of any desired design, construction, or structure, including conventional designs, constructions, or structures) and sole structures of the various types described above engaged with the upper. In some more specific examples, the upper may include a strobel member closing its bottom surface, wherein the strobel member overlies a top surface of the midsole component and all rigid plate components. Additionally or alternatively, if desired, a sock liner or insole member may overlie the midsole component and/or the strobel member (when present).

B. Method Features

Additional aspects of this invention relate to methods of making articles of footwear or various components thereof. One more specific aspect of this invention relates to methods for making sole structures for articles of footwear of the various types described above. While the various components and parts of the sole structures and articles of footwear according to aspects of this invention may be made in manners that are conventionally known and used in the art, examples of the method aspects of this invention relate to combining the sole structure and/or footwear parts and engaging them together in manners that produce the various structures described above.

Given the general description of features, aspects, structures, and arrangements according to the invention provided above, a more detailed description of specific example articles of footwear and methods in accordance with this invention follows.

II. Detailed Description of Example Sole Structures and Articles of Footwear According to this Invention Referring to the figures and following discussion, various sole structures, articles of footwear, and features thereof in accordance with the present invention are disclosed. The sole structures and footwear depicted and discussed are athletic shoes, and the concepts disclosed with respect to various aspects of this footwear may be applied to a wide range of athletic footwear styles, including, but not limited to: walking shoes, tennis shoes, soccer shoes, football shoes, basketball shoes, running shoes, cross-training shoes, golf shoes, etc. In addition, at least some concepts and aspects of the present invention may be applied to a wide range of non-athletic footwear, including work boots, sandals, loafers, and dress shoes. Accordingly, the present invention is not limited to the precise embodiments disclosed herein, but applies to footwear generally.

Figure 1B:
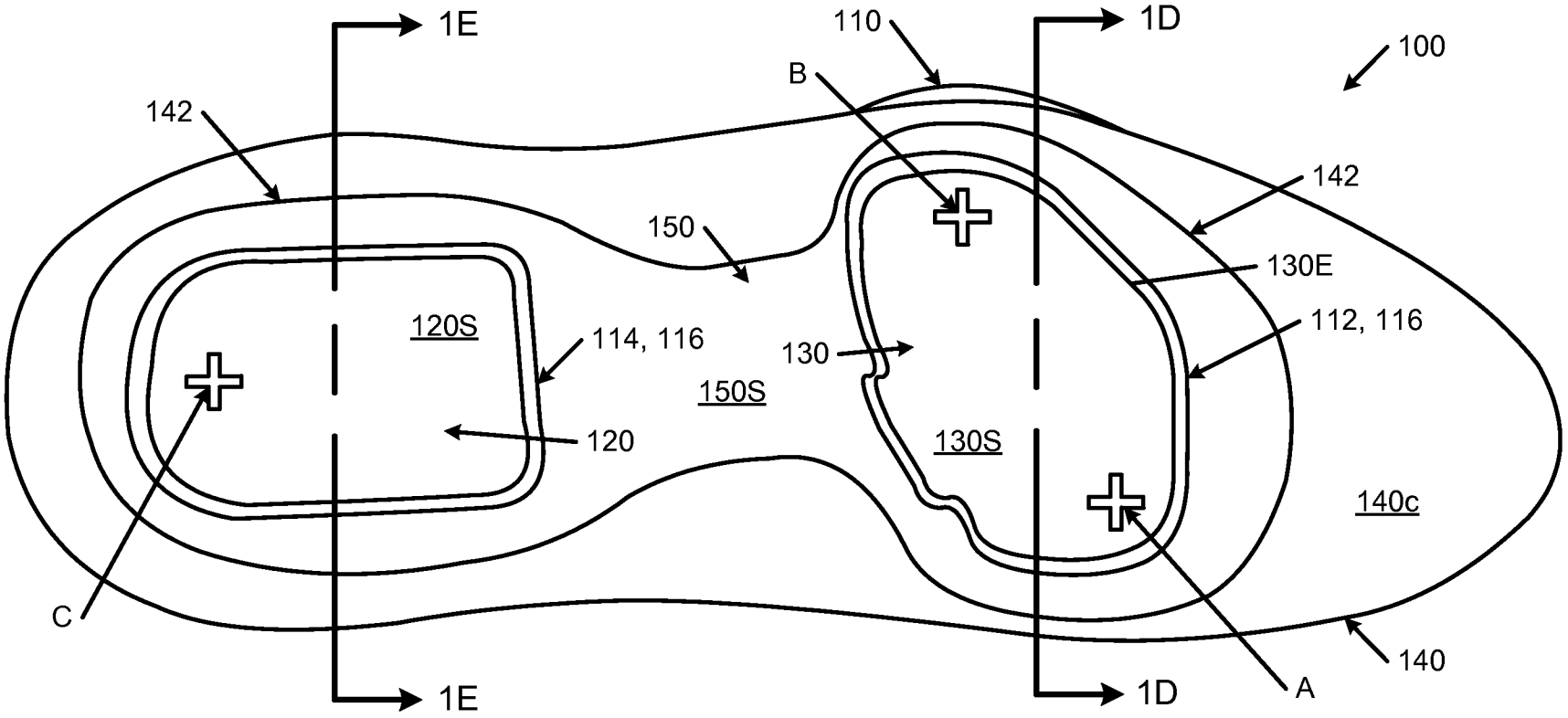
Figure 1C:
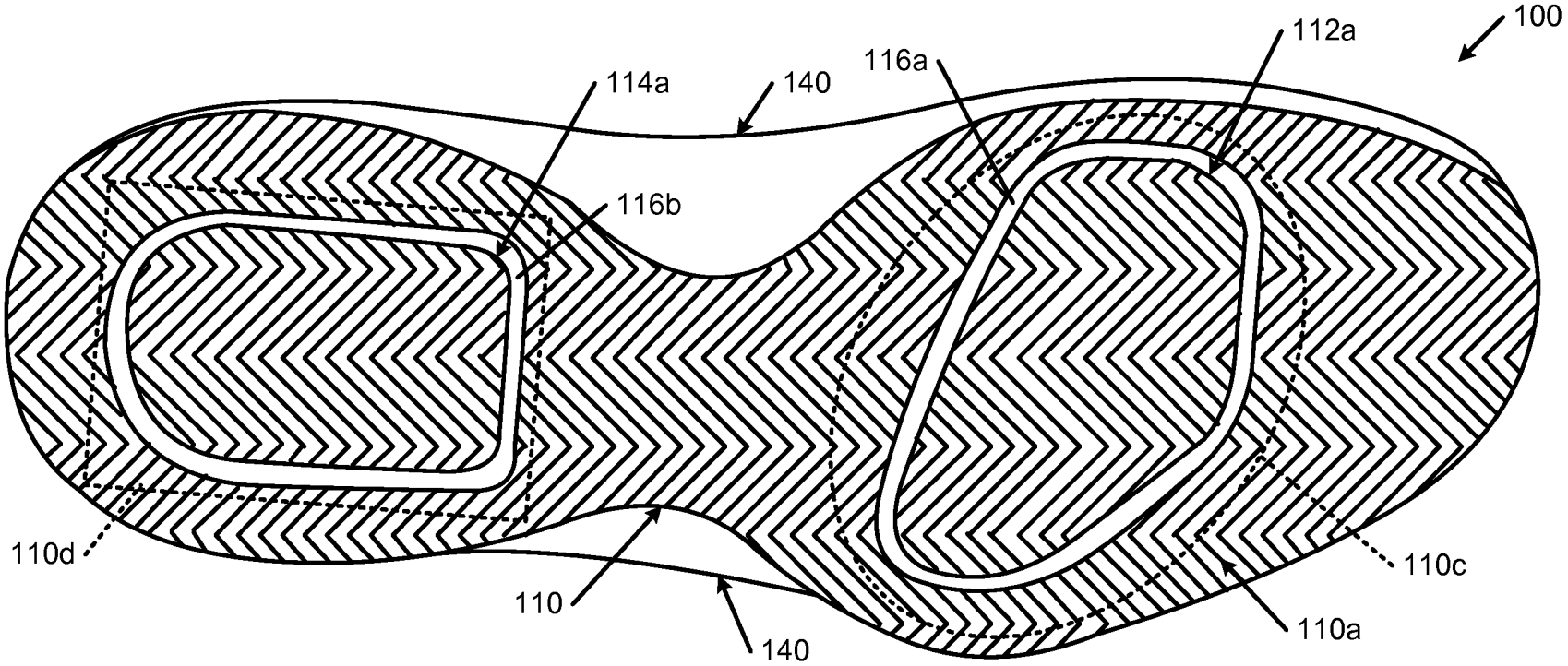
Figure 1D:
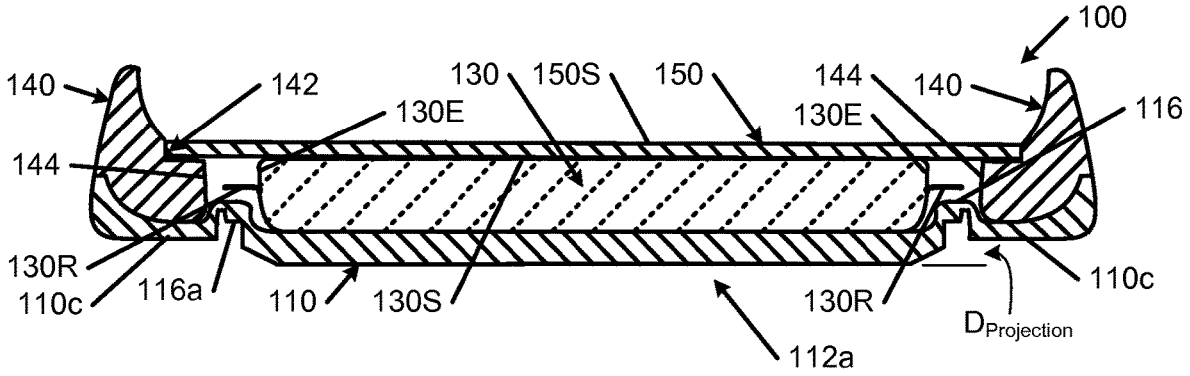
Figure 1E:
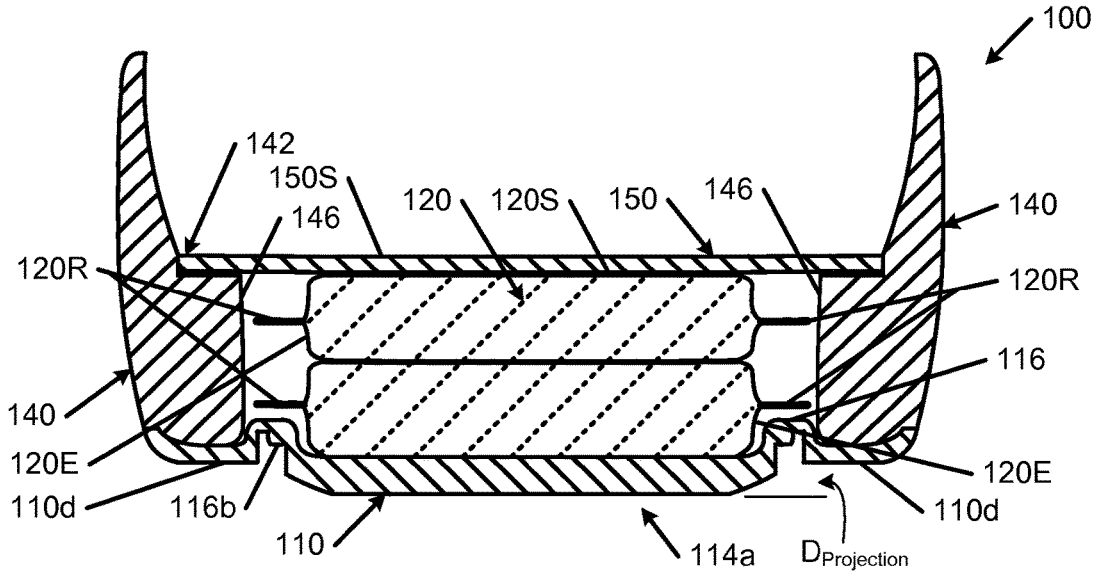

FIGS. 1A through 1E illustrate a first example sole structure 100 in accordance with some aspects of this invention. FIG. 1A constitutes an exploded view of the sole structure 100 (showing the constituent parts of this example structure 100), FIG. 1B is a top view, and FIG. 1C is a bottom view. FIG. 1D is a cross-sectional view taken along line 1D-1D in FIG. 1B, and FIG. 1E is a cross-sectional view taken along line 1E-1E in FIG. 1B. As shown in FIG. 1A, this example sole structure 100 includes an outsole component 110; a rearfoot fluid-filled bladder system 120; a forefoot fluid-filled bladder system 130; a midsole component 140; and a rigid plate component 150. Various features of these component parts and their construction are described in more detail below.

The outsole component 110 includes an exterior major surface 110*a* (which may include tread, cleats, raised surfaces, or other fraction elements, like the herringbone type structure shown in FIG. 1C) and an interior major surface 110*b*. While the outsole component 110 may be made as a single piece or part, as shown in these figures, if desired, it could be made from multiple pieces or parts, such as a forefoot component and a separate rearfoot or heel component. The outsole component 110 may be made from any desired materials, including materials that are conventionally known and used in the footwear art, such as rubbers, plastics, thermoplastic polyurethanes, and the like. Additionally, the outsole component 110 may be made in any desired manner without departing from this invention, including in conventional manners that are known and used in the footwear art (e.g., by molding processes). The interior major surface 110*b* of this illustrated example outsole component 110 includes a forefoot recessed area 112 and a rearfoot recessed area 114. Raised rims 116 molded into the major surface 110*b* define (and at least partially surround) the recessed areas 112, 114 in this example structure. These recessed areas 112 and 114 contain and help secure the fluid-filled bladder systems 120, 130, as will be explained in more detail below.

Turning also to FIGS. 1C through 1E, these figures provide additional details of the exterior major surface 110*a* of this example outsole component structure 110. More specifically, as shown in these figures, the exterior major surface 110*a* includes a forefoot projection area 112*a* corresponding to the forefoot recessed area 112 and a rearfoot projection area 114*a* corresponding to the rearfoot recessed area 114. The forefoot projection area 112*a* is at least partially surrounded by (and in this illustrated example, completely surrounded by) and projects beyond a first main outsole surface area 110*c* located around and adjacent to the forefoot projection area 112*a*. Similarly, the rearfoot projection area 114*a* is at least partially surrounded by (and in this illustrated example, completely surrounded by) and projects beyond a second main outsole surface area 110*d* located around and adjacent to the rearfoot projection area 114*a*. These "main outsole surface areas" 110*c* and 110*d* are shown as broken line enclosures in FIG. 1C, and this term is used herein to represent the outsole surface area immediately adjacent and outside the projection area (e.g., outside any connecting "web" material or gap as described herein). The projection areas 112*a* and 114*a* may extend below the main outsole surface areas 110*c* and 110*d* by a maximum (or highest) distance ($D_{Projection}$) of about 1-15 mm, and in some examples, by a distance of about 1.5 to 12 mm or even 1.75 to 10 mm. The projection height $D_{Projection}$ may be the same or different at the forefoot and rearfoot areas, and this projection height may vary around the perimeter of the projection areas 112*a* and 114*a*.

The forefoot projection area 112*a* of this illustrated example is connected to the first main outsole surface area 110*c* by a flexible web member 116*a*, and the rearfoot projection area 114*a* of this illustrated example is connected to the second main outsole surface area 110*d* by another flexible web member 116*b*. While not a requirement, if desired (and as illustrated in these figures), the flexible web members 116*a* and 116*b* may extend completely around their respective projection areas 112*a* and 114*a*. The flexible webs 116*a* and 116*b* form underside portions of the raised rims 116 described above.

The bottom major surface of midsole component 140 is engaged with the interior major surface 110*b* of the outsole component 110, e.g., by cements or adhesives, by mechanical connectors, and/or in other ways, including in conventional ways as are known and used in the art. The midsole component 140 may be a single piece or multiple pieces, and it may be made of conventional materials as are known and used in the art, such as polymer foam materials (e.g., polyurethane foams, ethylvinylacetate foams, phylon, phylite, etc.). As shown in FIG. 1A, midsole component 140 includes a forefoot opening 140*a* and a rearfoot opening 140*b*. The forefoot opening 140*a* at least partially surrounds the forefoot recessed area 112, and the rearfoot opening 140*b* at least partially surrounds the rearfoot recessed area 114. The top major surface 140*c* of this example midsole component 140 includes a recessed area 142 that extends at least partially around the forefoot opening 140*a* and rearfoot opening 140*b*. The recessed area 142 may be sized and shaped so as to receive and retain the bottom surface of the rigid plate component 150, as will be explained in more detail below.

The openings 140*a* and 140*b* help define chambers for receiving and holding the fluid-filled bladder systems 130 and 120, respectively. As shown in the example structure of FIG. 1D, a perimeter edge 130E of the forefoot fluid-filled bladder system 130 does not extend to and/or contact a side edge 144 of the forefoot opening 140*a* of the midsole component 140 when the forefoot fluid-filled bladder system 130 is in an uncompressed condition. Similarly, as shown in the example structure of FIG. 1E, a perimeter edge 120E of the rearfoot fluid-filled bladder system 120 does not extend to and/or contact a side edge 146 of the rearfoot opening 140*b* of the midsole component 140 when the rearfoot fluid-filled bladder system 120 is in an uncompressed condition. These gaps between perimeter edges 120E and 130E and the side edges 144, 146 of the openings 140*a*, 140*b* provide room to allow the fluid-filled bladder systems 120, 130 to deform, e.g., when placed in a stressed or loaded condition, for example, when a user steps down, lands a jump, etc. The rim areas 120R and 130R of these example fluid-filled bladder structures represent seam areas (e.g., a hot melt or welded seam) between two portions of plastic sheeting used in making the fluid-filled bladders of these examples. These rim areas 120R, 130R may or may not be spaced from the side edges 144, 146 of openings 140*a*, 140*b*. Alternatively, if desired, at least some portions of these rim areas 120R, 130R may be trimmed off from the fluid-filled bladder systems 120, 130 before the bladders are mounted in the sole structure 100. The openings 140*a* and 140*b* may generally correspond in size and shape to the bladder system to be received therein, although the openings 140*a*, 140*b* may be a little larger in order to provide the gap described above.

The fluid-filled bladder systems 120, 130 may be made in any desired manner and/or from any desired materials, including in conventional manners and/or using conventional materials as are known in the art. As shown in FIGS. 1A and 1D, in this illustrated example, the forefoot fluid-filled bladder system 130 constitutes a single fluid-filled bladder located at the forefoot recessed area 112. Forefoot fluid-filled bladder system 130 may have its bottom surface fixed to the interior major surface 110*b* of outsole component 110 within recessed area 112, e.g., using cements or adhesives. This example forefoot fluid-filled bladder system 130 is sized and positioned so as to support the metatarsal head regions of a wearer's foot (e.g., from the first metatarsal head area to the fifth metatarsal head area of the wearer's foot). While any size bladder system may be used without departing from this invention, in some example structures, the forefoot fluid-filled bladder system 130 will have a maximum thickness when inflated (and mounted in a sole structure) of 0.5 inches or less. As some other potential ranges, this forefoot fluid-filled bladder system 130 may have a thickness in a range from 0.25 to 1 inch (when inflated and mounted in a shoe) in at least some examples of this invention.

The rearfoot fluid-filled bladder system 120 of this example structure 100, on the other hand, as shown in FIGS. 1A and 1E, includes two stacked fluid-filled bladders located at the rearfoot recessed area 114 (vertically stacked and vertically aligned). The two stacked bladders may be identical or different from one another. Rearfoot fluid-filled bladder system 120 may have its bottom surface fixed to the interior major surface 110*b* of outsole component 110 within recessed area 114, e.g., using cements or adhesives. Additionally or alternatively, if desired, the two stacked fluid-filled bladders of the system 120 may be fixed together, e.g., using cements or adhesives. The rearfoot fluid-filled bladder system 120 supports the wearer's heel (e.g., the calcaneus bone and surrounding area). In some sole structures in accordance with aspects of this invention, this rearfoot fluid-filled bladder system 120 may have a thickness of 0.75 inches or less when inflated and mounted in a shoe. As some other potential ranges, this rearfoot fluid-filled bladder system 120 may have a thickness in a range from 0.5 to 1.5 inches (when inflated and mounted in a shoe), or even within a range from 0.625 to 1.25 inches, in at least some examples of this invention.

The top surfaces 120S and 130S of the fluid-filled bladder systems 120 and 130 of this example structure 100 are sized and shaped so as to lie within the recessed area 142 and lie flush with (and/or smoothly contour into) the top major surface 140*c* outside of the recessed area 142. If desired, one or more of the individual bladders of the fluid-filled bladder systems 120, 130 may include internal structures (e.g., tensile elements) and/or internal fuse or weld bonds between the top and bottom surfaces thereof to control the shape of the bladder, e.g., in manners that are known and used in the art. As some more specific examples, the shapes of the bladders may be controlled using NIKE "ZOOM AIR" type technology (e.g., with tensile members provided in the fluid-filled bladders) and/or internal bonding or weld technology, such as the technologies described in U.S. Pat. Nos. 5,083,361, 6,385,864, 6,571,490, and 7,386,946, each of which is entirely incorporated herein by reference.

FIGS. 1A, 1B, 1D, and 1E further illustrate that the recessed area 142 of midsole component 140 and the top surfaces 120S and 130S of the fluid-filled bladder systems 120, 130 of this example are at least partially covered (and in this illustrated example, fully covered) by the rigid plate component 150. The rigid plate component 150 may be made from a suitable stiff and rigid material, such as non-foam, plastic materials including fiber reinforced plastics (e.g., carbon fiber composites, fiberglass, etc.), rigid polymers (e.g., PEBAX), or the like. The rigid plate component 150 may be sized and shaped to lie within the recessed area 142 such that there is a flush and/or smooth transition at the junction between the top surface 150S of the rigid plate component 150 and the top surface 140*c* of the midsole component 140 around the recessed area 142. As a more specific example, the rigid plate component 150 may be about ⅛ to ⅜ inch thick, and in some examples, about ⅛ to ¼ inch thick. Also, if desired, the bottom surface of the rigid plate component 150 may be fixed to the recessed area 142 and/or to the top surfaces 120S and 130S of the fluid-filled bladder systems 120, 130, e.g., by cements or adhesives, by mechanical connectors, or the like. The top surface 150S of the rigid plate component 150 and the top surface 140*c* of the midsole component may be curved, arched, and/or otherwise contoured so as to comfortably support a wearer's foot (e.g., curved in manners in which top surfaces of conventional and known midsoles are curved). As some even more specific examples, the rigid plate component 150 (as well as the other rigid plate components described below) may be made from a PEBAX® Rnew 70R53 SPOT material or other rigid material having a hardness of 50 to 80 Shore D, and in some examples, from 60 to 72 Shore D ("PEBAX" is a registered trademark for a polyether block amide material available from Arkema).

In this illustrated example structure 100, the rigid plate component 150 constitutes a single, contiguous plate member that extends from a rear heel area of the midsole 140 to a location beyond the first metatarsal head region of the wearer's foot and to a location beyond the fifth metatarsal head region of the wearer's foot. The rigid plate component 150 of this example also completely covers the top surfaces 120S, 130S of the two fluid-filled bladder systems 120, 130. The rigid plate component 150 helps moderate and disperse the load applied to the fluid-filled bladder system(s) and helps avoid point loading the fluid-filled bladder systems. The gaps between side walls 144, 146 of the midsole component 140 and the edges 120E, 130E of the fluid-filled bladder systems 120, 130, and the lack of adhesive along these sides, improves the responsiveness, efficiency, and return energy of this rigid plate moderated, fluid-filled bladder impact-attenuation system and/or sole structure.

In the structure of FIGS. 1A through 1E, the fluid-filled bladder systems 120, 130 are fixed to and between the interior major surface 110*b* of the outsole component 110 and the bottom surface of the rigid plate 150, but not to the midsole component 140. This feature allows the fluid-filled bladders to expand within the gaps provided in openings 140*a* and 140*b* while still maintaining a stable overall sole structure 100. As noted above, this feature also helps improve responsiveness, efficiency, and return energy of the system.

Also, the inclusion of the projection areas 112*a* and 114*a* in the outsole component 110 helps provide a more responsive sole structure 100. As shown in FIGS. 1D and 1E, beneath the fluid-filled bladder systems 120, 130, the outsole component 110 projects downward beyond the adjacent, surrounding outsole base areas 110*c* and 110*d* (dimension $D_{Projection}$ described above). The thinned, flexible web structures 116*a*, 116*b* allow the outsole component 100 to more easily flex upward and downward in the projection areas 112*a*, 114*a*. These features, together with the overall rigid plate component 150, return energy to the user's foot as the user steps down on the projection areas 112*a*, 114*a* and begins lifting the foot, which provides rebound energy, responsiveness, and the feel of a propulsive force.

The rigid plate component 150 may include other features that assist in providing rebound energy, responsiveness, and propulsive feel to sole structures in accordance with at least some examples of this invention. While the rigid plate component 150 may be relatively flat, in some example structures according to the invention, it will include a curved arch area.

Figure 1G:
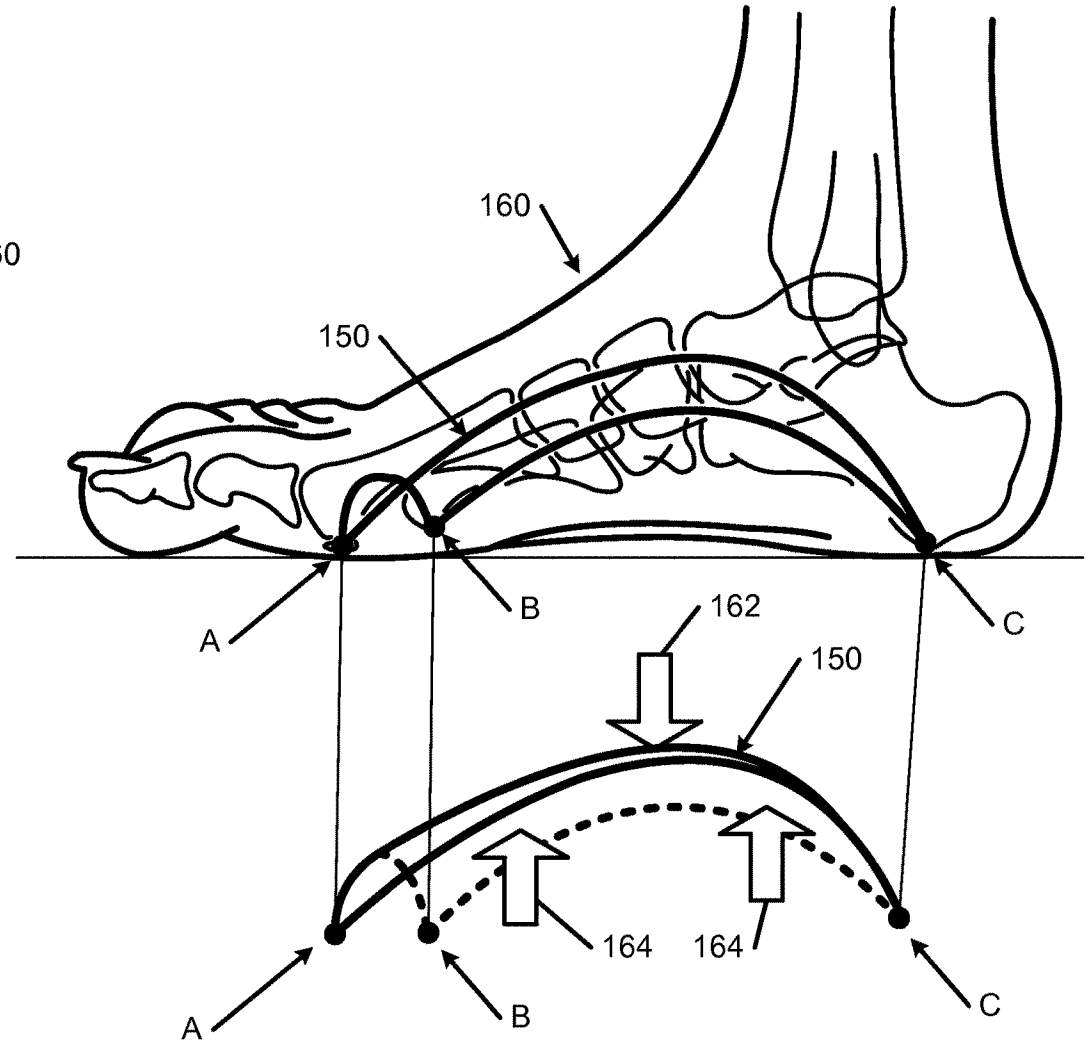
Figure 1F:
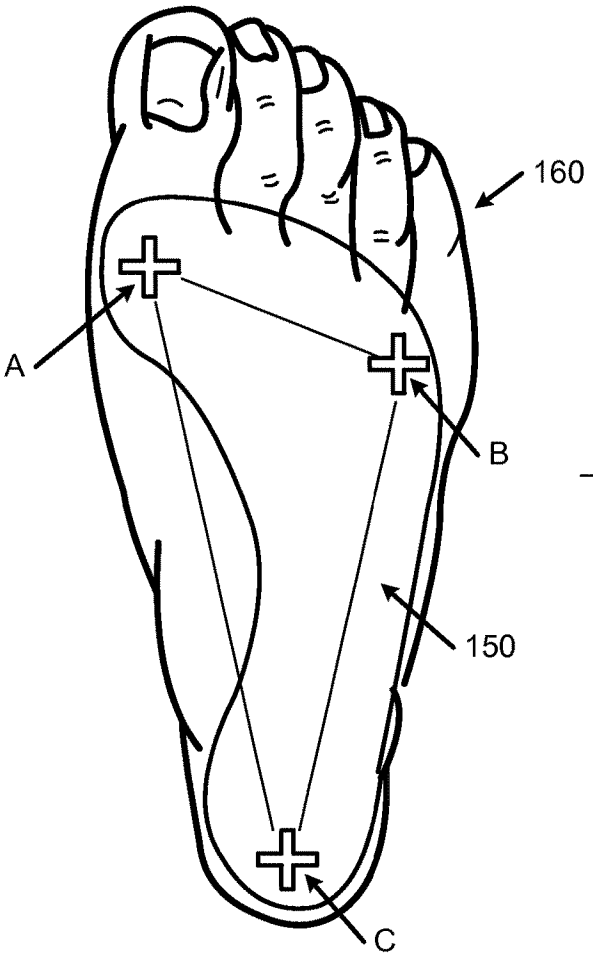

This feature is illustrated schematically in FIGS. 1F and 1G. FIG. 1F shows a top-down view of a foot 160 over a rigid plate member 150, e.g., like that shown in FIGS. 1A and 1B, and FIG. 1G shows a side view. Locations A, B, and C (see also FIG. 1B) show where the rigid plate component 150 supports the first metatarsal head (location A), the fifth metatarsal head (location B), and the rear heel (e.g., calcaneus bone) (location C). One or more of these locations A, B, C may be subjected to downward force as the wearer's foot 160 puts weight on the shoe (e.g., during a step, when landing a jump, when loading to initiate a jump, etc.). As shown in FIG. 1G, the rigid plate component 150 may be arched in the heel-to-toe direction and/or in the medial side-to-lateral side direction.

If the rigid plate component 150 is upwardly arched somewhat (e.g., as shown somewhat exaggerated in FIG. 1G), a sufficient downward force on the rigid plate component 150 will cause the plate 150 to flatten out somewhat, particularly when sufficient force is present on both the forefoot and rearfoot portions of the plate 150. Such a force is shown in FIG. 1G by downward force arrow 162. The downward force 162 may cause the rigid plate component 150 to flatten out in either or both of the heel-to-toe direction and/or in the medial side-to-lateral side direction. Due to its stiff character and curved construction, the rigid plate component 150 may act as a spring so that when the downward force 162 is sufficient reduced or released, the rigid plate component 150 will strive to return to its unstressed (unflattened) shape and condition, thereby causing a rebound or return force, shown in FIG. 1G by upward force arrows 164. This return or rebound force 164 provides additional rebound energy, responsiveness, and propulsive feel to sole structures in accordance with examples of the invention that include a curved rigid plate component 150.

Figure 1H:
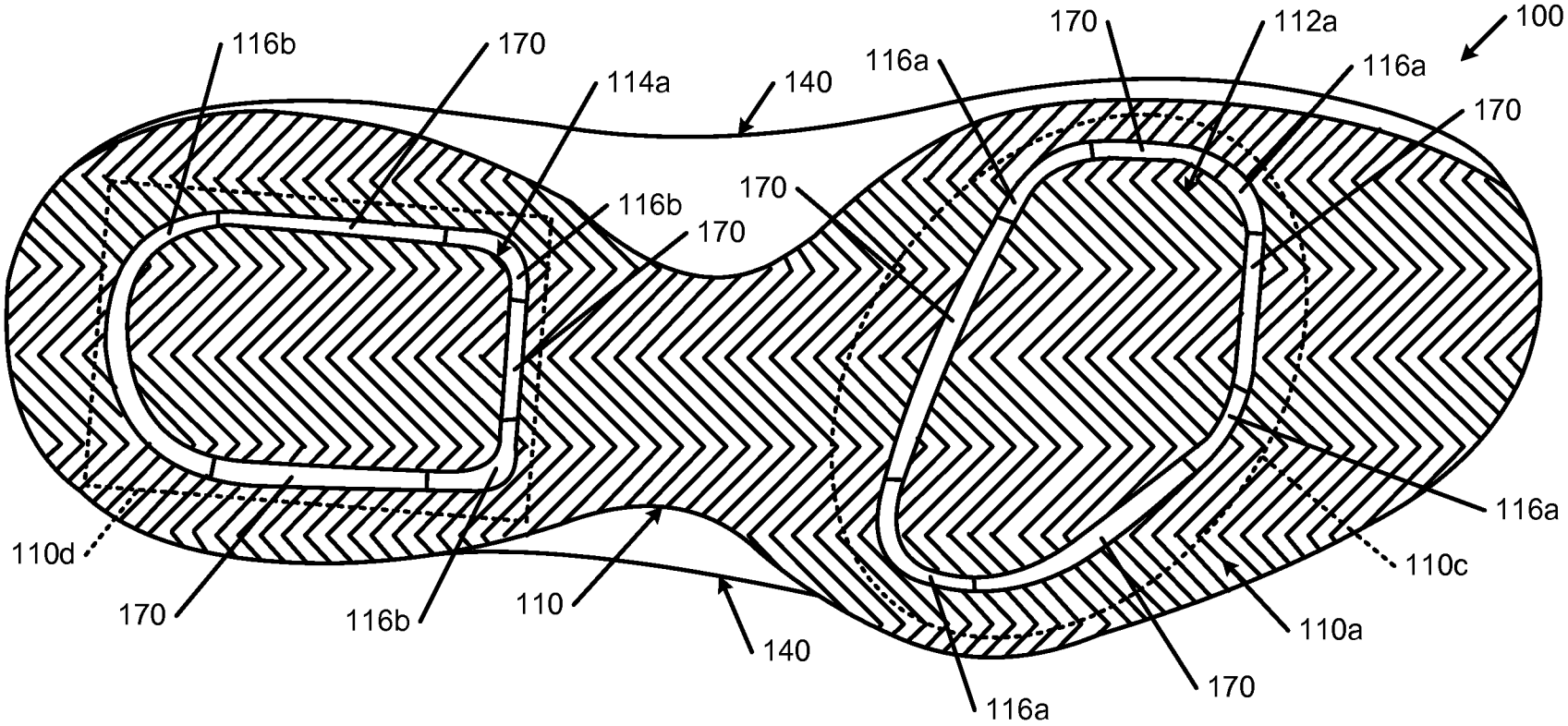
Figure 1I:
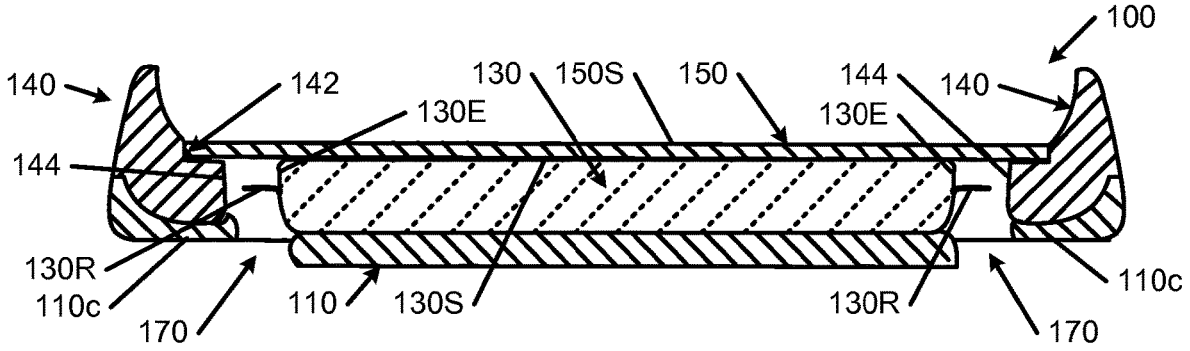
Figure 1J:
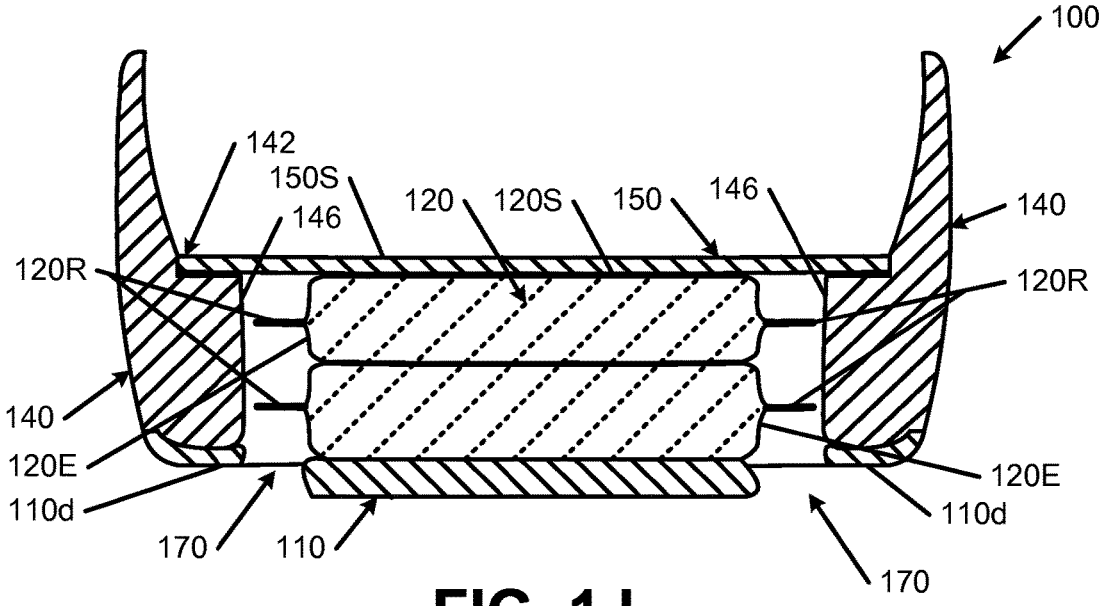

In the structures described above in conjunction with FIGS. 1A through 1E, the projection areas 112*a* and 114*a* of the outsole component 110 are engaged with the base portions 110*c* and 110*d*, respectively, of the outsole component 110 by flexible webs 116*a* and 116*b*, respectively, that extend around the entire perimeter of the projection areas 112*a* and 114*a*. This is not a requirement. Rather, as illustrated in FIG. 1H (which is a view similar to FIG. 1C described above), the flexible web areas 116*a* and/or 116*b* may be discontinuous around the perimeter of the projection areas 112*a* and 114*a*. Open spaces 170 may be provided around the perimeter of the projection areas 112*a* and 114*a* between adjacent web areas 116*a* and 116*b*. FIGS. 1I and 1J show cross sections views similar to FIGS. 1D and 1E respectively, except showing the cross section at areas where the open spaces 170 are provided in the flexible web areas 116*a* and 116*b*.

Any number of separated flexible web areas 116*a* and/or 116*b* and open spaces 170 may be provided around a perimeter of the projection areas 112*a* and/or 114*a* without departing from this invention. In some example constructions, at least 25% of the perimeter length around the respective projection area 112*a*, 114*a* will include flexible web area, and at least 40% of this perimeter length or even at least 50% of this perimeter length may constitute flexible web area in some examples.

As yet another example, if desired, one or more of the flexible web areas 116*a* and 116*b* around a projection area 112*a* and/or 114*a* can be completely omitted, i.e., so that the projection areas 112*a* and/or 114*a* of the outsole are separate components from the outsole component(s) making up the base areas 110*c* and/or 110*d*, respectively. The projection area 112*a* and/or 114*a* may still project outward from the base areas by a desired distance (e.g., $D_{Projection}$ described above). In such a structure, the projection area(s) 112*a* and/or 114*a* may be fixed to the remainder of the sole structure in any desired manner, such as by fixing the projection areas 112*a* and/or 114*a* with the overlying fluid-filled bladder systems 120 and 130, by fixing the fluid-filled bladder systems 120 and 130 with the plate component 150, and by fixing the plate component 150 with the midsole component 140. Alternatively, the plate component 150 may be fixed, for example, to the upper (e.g., to a strobel member, as described in more detail below). The various parts may be fixed together in any desired manner, including through the use of cements or adhesives and/or through the use of mechanical connectors.

If necessary or desired, in structures in which the flexible webs 116*a* and/or 116*b* are discontinuous or omitted, a membrane or other structure may be provided, e.g., within the openings 140*a* and/or 140*b*, to help prevent water, moisture, debris, or other foreign objects from penetrating the sole structure and/or entering the footwear interior chamber.

Figure 2A:
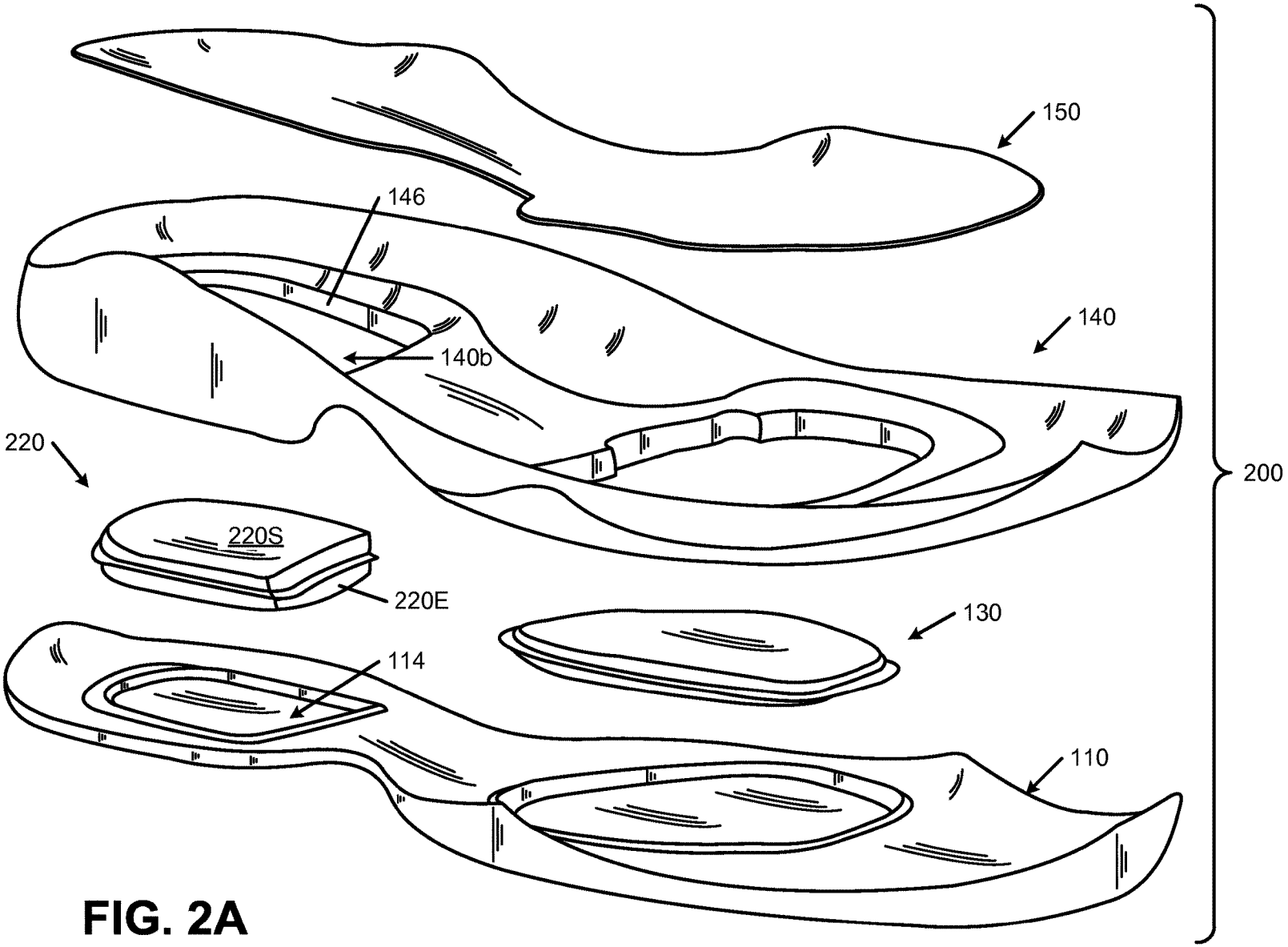
FIGS. 2A through 2C show various views of sole structures according to other examples of this invention.
Figure 2B:
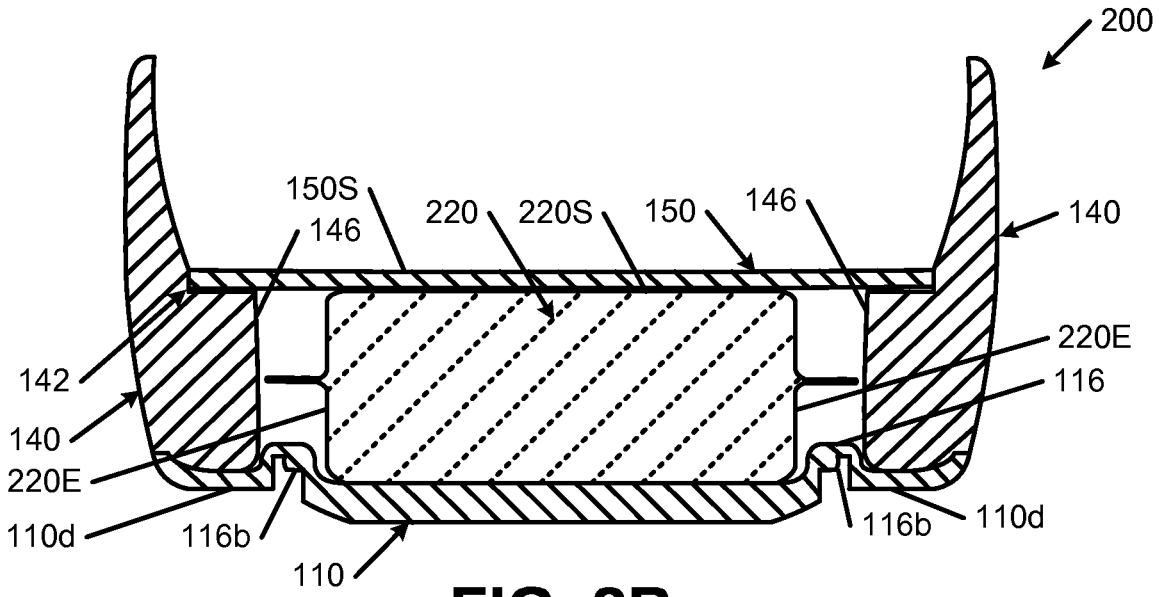

FIGS. 2A and 2B illustrate an alternative example sole structure 200 according to this example aspect of the invention. The main difference between this example sole structure 200 and that shown in FIGS. 1A through 1E relates to the rearfoot fluid-filled bladder system 220. Rather than the stacked fluid-filled bladders shown in FIGS. 1A and 1E (e.g., NIKE "ZOOM AIR" type fluid-filled bladders), in this example structure 200, the rearfoot fluid-filled bladder system 220 includes a single fluid-filled bladder received in the opening 140*b* within the midsole component 140. The top surface 220S of this fluid-filled bladder system 220 may be fixed to the bottom surface of the rigid plate component 150, e.g., using cements or adhesives. Likewise, the bottom surface of this fluid-filled bladder 220 may be fixed to the interior major surface 110*b* of the outsole component 110, in the recess area 114, for example, using cements or adhesives. The side edges 220E of this fluid-filled bladder system 220 may be spaced from the side edges 146 of rearfoot opening 140*b* to allow room for expansion of the bladder 220, e.g., as discussed above. The fluid-filled bladder system 220 will function in generally the same manner as described above for fluid-filled bladder system 120. Also, the fluid-filled bladder 220 may include tensile elements, internal welds, and/or other structures to help control and maintain its shape.

Figure 2C:
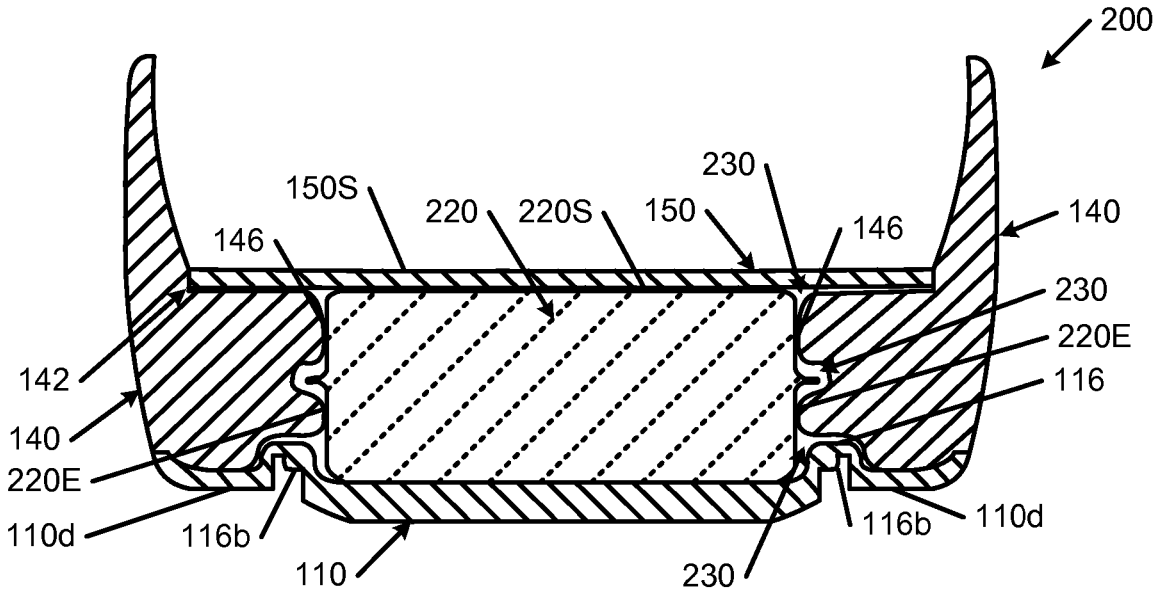

FIGS. 1D, 1E, 1I, 1J, and 2B illustrate constructions in which a distinct gap exists between a perimeter edge 120E, 130E, and 220E of a fluid-filled bladder and an interior edge 144 and 146 of the midsole component 140 in the openings 140*a* and 140*b*. The gap may be of any desired size and/or volume without departing from this invention, provided adequate volume is provided to accommodate changes in shape to the midsole component and/or the fluid-filled bladder when a compressive force is applied to the sole structure. FIG. 2C illustrates an example structure in accordance with at least some examples of this invention in which portions of the fluid-filled bladder edge 220E extend to and even contact portions of the edge 146 of the midsole component 140 within the opening area 140*b* (a similar side edge construction and contact between bladder edges and opening edge 144 could be used in the forefoot opening 140*a*, if desired). In the illustrated example structure of FIG. 2C, some spaces 230 are provided near the top, center, and/or bottom areas of the fluid-filled bladder system 220 to accommodate deflection and/or changes in size of the fluid-filled bladder system 220 and/or the midsole component 140.

Figure 3A:
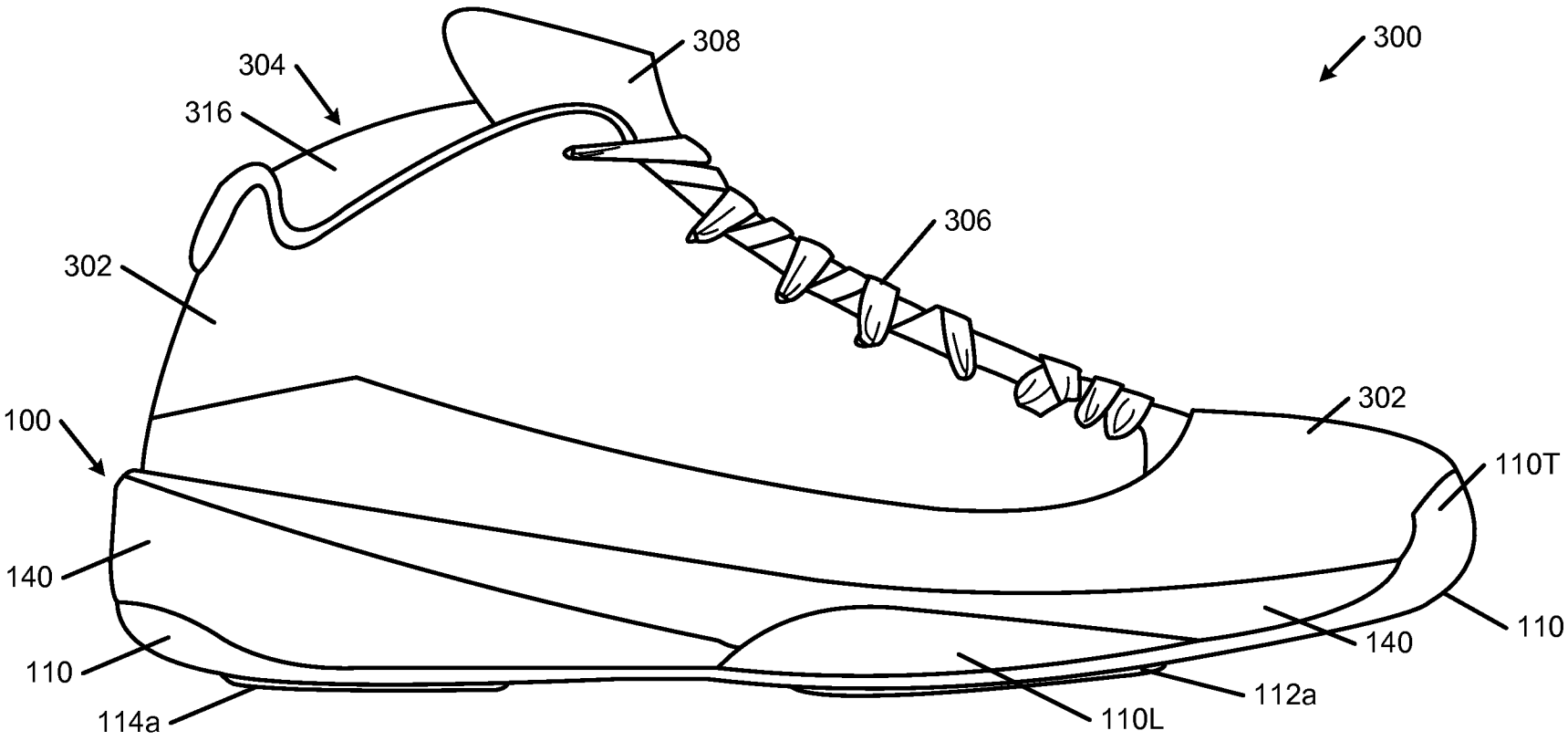
FIGS. 3A through 3D show various views of an article of footwear including a sole structure according to at least some examples of this invention.
Figure 3B:
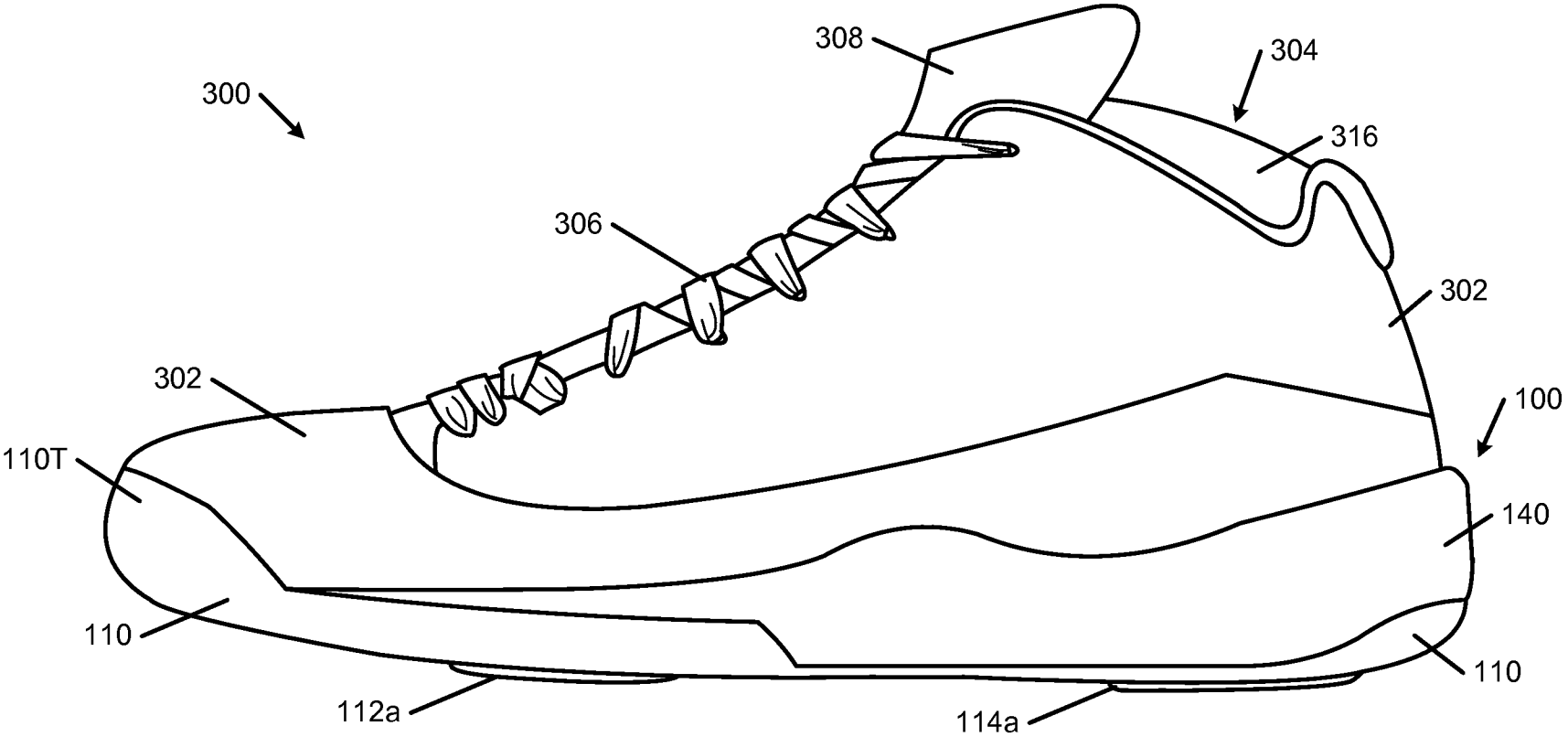
Figure 3C:
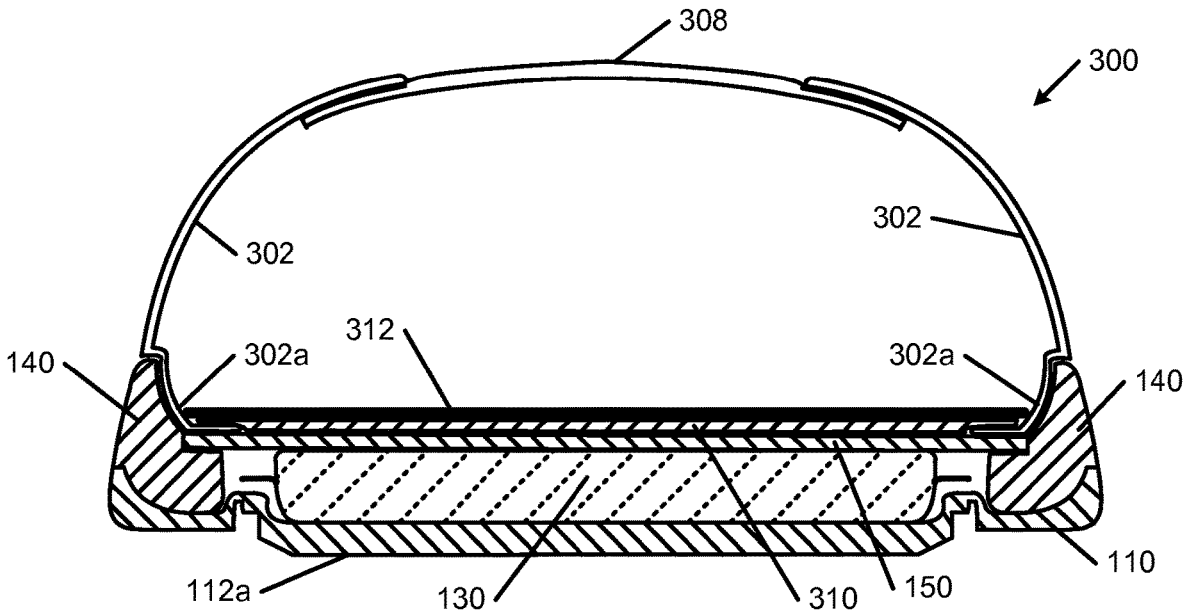
Figure 3D:
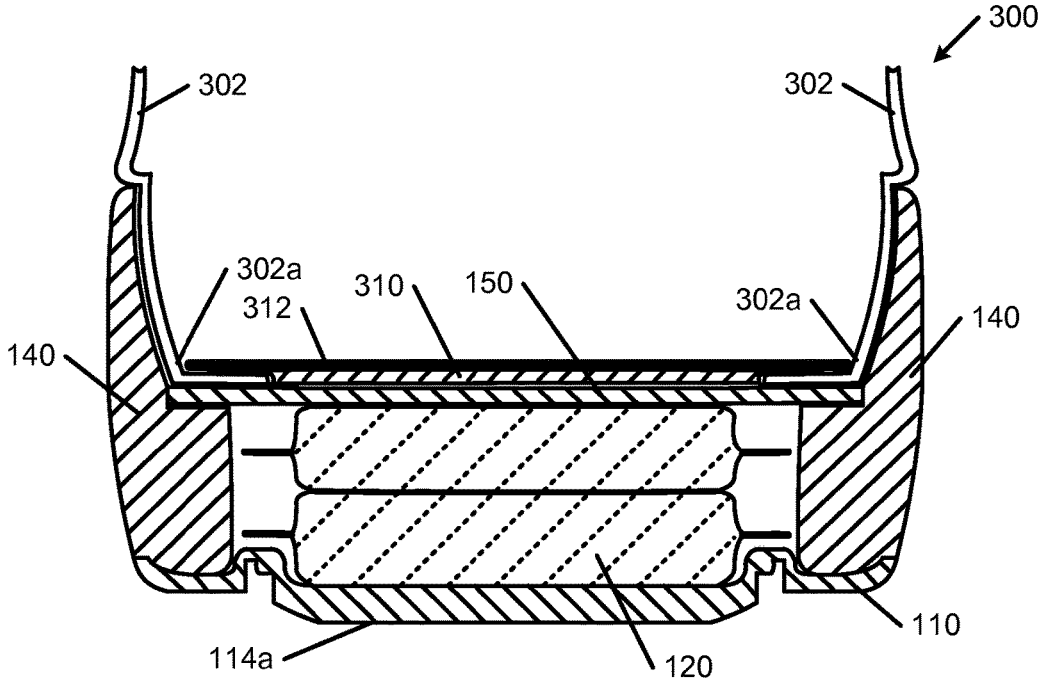

FIGS. 3A through 3D illustrate an example article of footwear 300 including a sole structure 100 like those described above in conjunction with FIGS. 1A through 2C. FIG. 3A shows a lateral side view of the shoe 300, FIG. 3B shows a medial side view, and FIGS. 3C and 3D are cross sectional views at locations like those shown in FIGS. 1D, 1E, and 2B, but with at least some of the footwear upper 302 and other component parts also shown. While the sole structure shown in FIGS. 3A-3D more closely corresponds to that shown in FIGS. 1A through 1E, those skilled in the art, given benefit of this disclosure, will recognize that the sole structures of FIGS. 2A through 2C also could be used in footwear, e.g., of the type shown in FIGS. 3A through 3D, without departing from this invention.

The upper 302 may have any desired construction and may be made from any desired number of parts and/or materials (connected in any desired manner), including conventional constructions, parts, and/or materials as are known and used in the footwear art. The upper 302 may be designed to provide regions with desired characteristics, such as regions with increased durability and/or abrasion resistance, regions of increased breathability, regions of increased flexibility, regions with desired levels of support, regions with desired levels of softness or comfort, etc. As shown in FIGS. 3A and 3B, the upper 302 includes an ankle opening 304 and one or more securing systems 306 (such as laces, straps, buckles, etc.) for securing the footwear 300 to a wearer's foot. A tongue member 308 can be provided over the instep area of the shoe 300 to help moderate the feel of the securing system 306 at the wearer's foot.

As best shown in FIGS. 3C and 3D, in this example structure 300, the lower edges 302*a* of the upper 302 are connected together by a strobel member 310 that closes off the bottom of the overall upper 302. This connection may be made, for example, by sewing the upper edges 302*a* to the strobel member 310, or in any other desired manner, e.g., as is known and used in the art. The strobel member 310 and upper 302 of this example construction form a foot-receiving chamber accessible through the ankle opening 304. The upper 302 and strobel member 310 may be engaged with the sole structure 100, e.g., by gluing or otherwise securing the upper 302 and strobel 310 to the midsole component 140 (e.g., to the side and/or top surfaces of the midsole component 140) and/or the rigid plate component 150 (e.g., to its top surface). As further shown in FIGS. 3C and 3D, the foot-receiving chamber of the upper 302 further may include a sock liner 312 (also referred to as an "insole"). While it may be secured within the foot-receiving chamber, the sock liner 312 also may simply lay atop the strobel member 310. The sock liner 312 may be made from a soft, comfortable material (e.g., a foam material), to provide a soft, comfortable surface for engaging the wearer's foot.

Alternatively, if desired, one or more of the strobel member 310, the sock liner 312, and/or the tongue member 308 may be replaced by an interior bootie member or other structure for receiving the wearer's foot. As another option, e.g., as shown in FIGS. 3A and 3B, the area around the ankle opening 304 may be provided with a soft, comfortable fabric element 316, to make a comfortable fit to the wearer's foot when the securing system is tightened.

In the sole structure 100 shown in FIG. 3A, the lateral side of the outsole 110 includes a raised lateral edge 110L that extends around and supports the side surface of the midsole component 140 along the lateral midfoot/forefoot area (e.g., along the side of the fifth metatarsal head region). This lateral edge 110L provides additional support for the lateral side of the foot, e.g., during a cutting or turning action. The front of the outsole 110 also extends upward to form a toe cap type structure 110T (e.g., to provide durability and abrasion resistance at the toe). The outsole 110 may wrap around at least some side areas of the midsole component 140 at any desired locations to provide increased area for a secure and durable connection to the midsole component 140 and/or to provide increased support.

Figure 4A:
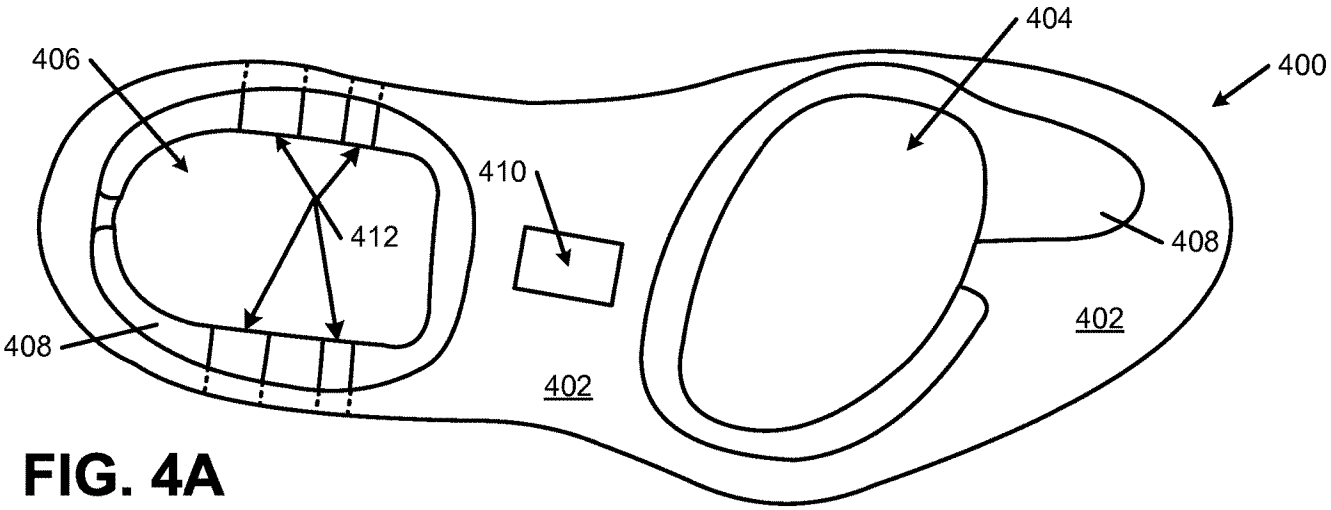
FIGS. 4A and 4B show various views of a midsole component in accordance with some examples of this invention.
Figure 4B:
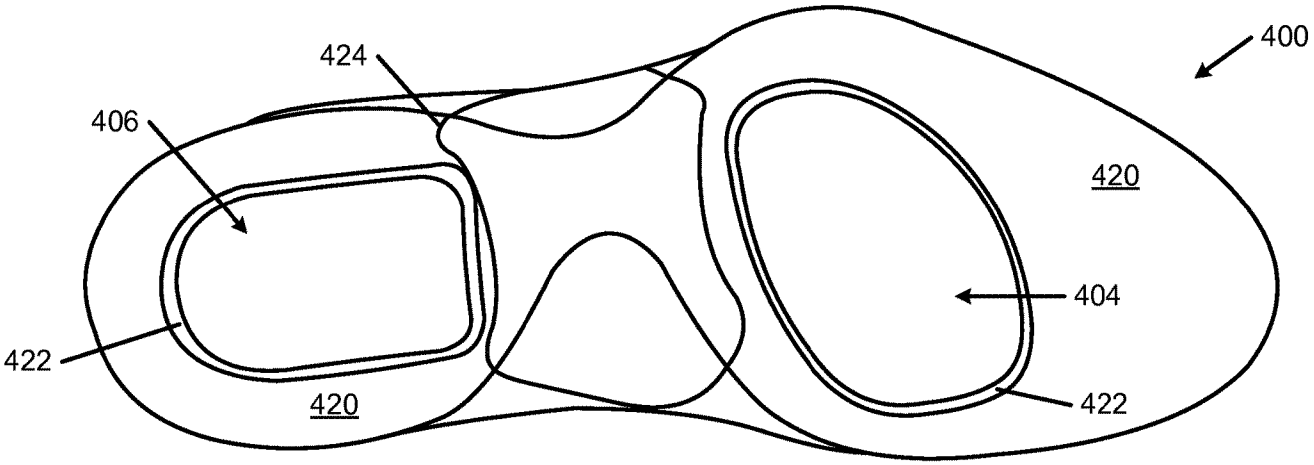

FIGS. 4A and 4B illustrate top and bottom views, respectively, of another example midsole component 400 that may be included in sole structures in accordance with at least some examples of this invention. As shown in FIG. 4A, this example midsole component 400 includes a top major surface 402 with a forefoot opening 404 and a rearfoot opening 406 defined therein for receiving fluid-filled bladder systems (or potentially other impact-attenuating systems, such as foam materials). Recessed areas 408 are provided in the top major surface 402 that extend at least partially around the openings 404, 406 for receiving rigid plate components as will be described in more detail below. While described as through holes, openings 404 and/or 406 may be blind holes that only partially extend through the material of the midsole component 400, if desired. The top surface 402 of midsole component 400 further may include a blind hole 410, e.g., for receiving an electronic module for measuring athletic performance associated with use of an article of footwear including this midsole component 400. Electronic modules of this type for inclusion in footwear are known and commercially available, such as electronic modules used in NIKE+™ type systems.

FIG. 4A shows additional features that may be included in midsole components 400 in accordance with at least some examples of this invention. Recessed area 408 around the rearfoot opening 406 in this example structure 400 includes cutout areas 412 that extend close to the bottom of the midsole component 400 (but not quite all the way through the midsole component 400, although they could extend the entire way through, if desired). These cutout areas 412 align with through holes provided in the side wall of the midsole component 400 (shown as broken lines in FIG. 4A), which in turn provide visual access to the interior of the midsole component 400 from the exterior of the sole structure. This feature will be described in more detail below in conjunction with FIGS. 5B and 5C.

The bottom major surface 420 of the midsole component 400 of this example includes recessed rims 422 around the openings 404, 406, e.g., to provide a receptacle for receiving the raised rim 116 of outsole component 110, as shown in FIG. 1A. Bottom major surface 420 of the midsole component 400 may be joined to an outsole component, e.g., like component 110 shown in FIG. 1A.

This bottom major surface 420 of this example structure 400 further includes a recessed area 424 in the arch or midfoot region. This recessed area 424 may be sized and shaped to receive a correspondingly sized and shaped arch support member, such as a carbon fiber or polyether block amide arch support plate. The recessed area 424 may be of an appropriate depth (e.g., ⅛ inch to ¼ inch) such that the support plate fits therein in a smooth, flush manner, making an overall smooth and flush joint between these parts.

FIGS. 5A through 5D show top, lateral side, medial side, and bottom views, respectively, of a sole structure 500 including a midsole component 400 of the types described above in conjunction with FIGS. 4A and 4B. This example sole structure 500 includes a frontfoot fluid-filled bladder system 130 and a rearfoot fluid-filled bladder system 120 of the types described above in conjunction with FIGS. 1A through 1E, although variations in the overall structure, including variations in the number of bladders, are possible without departing from this invention (e.g., sole structures in accordance with the invention may have only a forefoot bladder or only a rearfoot bladder, if desired).

Figure 5A:
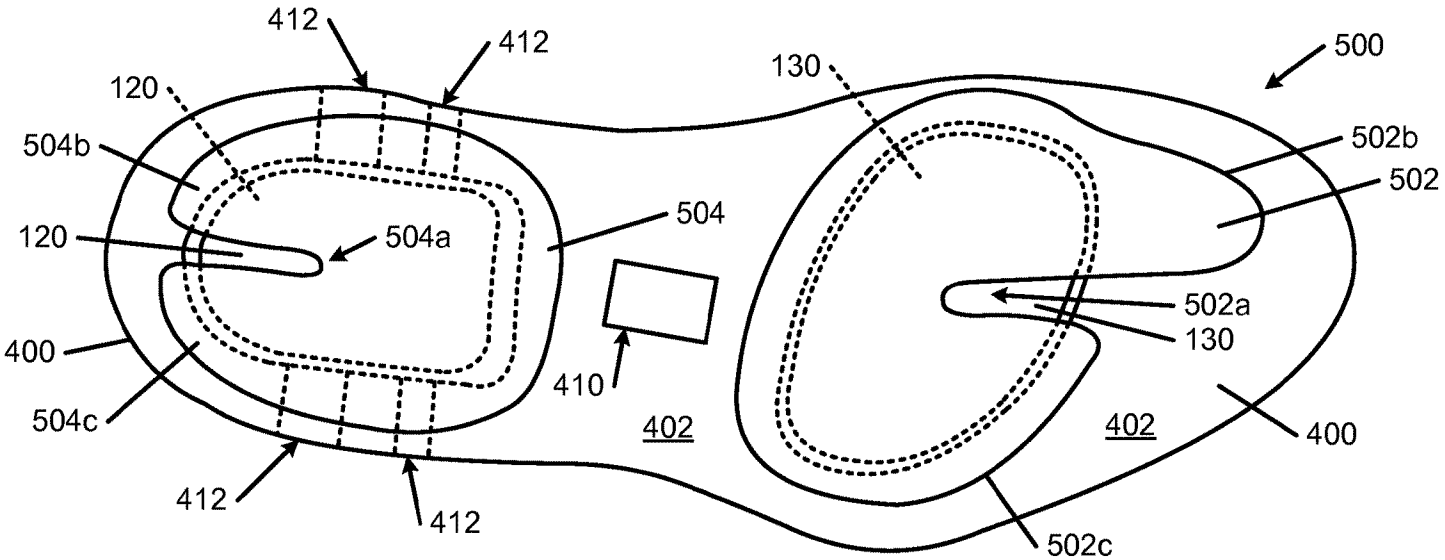
FIGS. 5A through 5E show various views of sole structures in accordance with some examples of this invention.

One main difference between the sole structure 500 of this illustrated example and those of FIGS. 1A through 2C relates to the rigid plate component. While FIGS. 1A through 2B show a single rigid plate member 150, in this illustrated sole structure 500, the rigid plate component includes a frontfoot rigid plate member 502 and a separate rearfoot rigid plate member 504. A gap is provided between the frontfoot rigid plate member 502 and the rearfoot rigid plate member 504 in the arch/midfoot area, as shown in FIG. 5A. The rigid plate members 502, 504 fit into the recessed areas 408 provided on the top major surface 402 of the midsole component 400, as described above. The rigid plate members 502, 504 (e.g., made from stiff plastic, fiber reinforced plastics, polyether block amides, etc., as described above) may be secured to the recessed area 408 and/or the top surfaces of fluid-filled bladder systems 120, 130, e.g., by cements or adhesives or other desired connection systems.

Further support in the arch area is provided in this example sole structure 500 by the external arch support plate 506 that extends across the arch area from the lateral, exterior side of the midsole component 400 to the medial exterior side of the midsole component 400. Notably, in this example structure 500, the arch support plate 506 is provided on the bottom major surface 420 of the midsole component 400, the surface opposite the location where rigid plate members 502, 504 are mounted. The arch support plate 506 is mounted within recessed area 424 provided on the bottom major surface 420 of midsole component 400 (see FIG. 4B), and it is partially covered by the outsole component 110 (the covered portion being shown in broken lines in FIGS. 5B through 5D). This arch support plate 506 may be made from any desired material, such as stiff polymer materials (e.g., PEBAX® brand polyether block amide materials), fiber reinforced polymer materials (e.g., carbon fiber, fiberglass, etc.), metal materials, etc. If desired, the arch support plate 506 may be located, sized, and/or shaped so as to provide at least some of the spring back or propulsive effect described above in conjunction with FIGS. 1F and 1G.

Providing a forefoot rigid plate component 502 separate from the rearfoot rigid plate component 504 can enhance the flexibility of the overall sole structure 500 and at least somewhat decouple flexion and motion of the rearfoot area from the forefoot area. This decoupling can improve the overall comfort and feel of the shoe as the wearer takes a step (and weight shifts from the heel to the forefoot) and provide a more natural motion and feel. The optional arch support plate 506 can provide additional stability, and its location at the outside of the midsole component 400 can improve the overall feel and comfort of the sole structure 500, particularly in the midfoot area.

FIG. 5A shows additional features that may be provided in sole structures in accordance with at least some examples of this invention. In this illustrated sole structure 500, the forefoot rigid plate 502 includes a groove 502*a* that separates a first metatarsal support region 502*b* from a fifth metatarsal support region 502*c* (and optionally from other metatarsal support areas). Additionally, as shown, the first metatarsal support region 502*b* extends forward to support all or substantially all of the big toe area of the wearer's foot. The groove 502*a* leaves a small portion of the top surface of the forefoot fluid-filled bladder system 130 exposed at the top major surface 402 of the midsole component 400. Similarly, the rearfoot rigid plate 504 includes a groove 504*a* in the rear heel area that separates a medial heel support region 504*b* from a lateral heel support region 504*c*. The groove 504*a* leaves a small portion of the top surface of the rearfoot fluid-filled bladder system 120 exposed at the top major surface 402 of the midsole component 400.

The grooved areas 502*a* and/or 504*a* in the forefoot and rearfoot plate components 502, 504, respectively, can enhance the flexibility of the overall sole structure 500 and at least somewhat decouple flexion of the lateral side of the foot from the medial side of the foot. During walking, running, or other ambulatory activities, a person typically will land a step at the lateral heel side of the shoe, and as the step continues, the weight force will move from the lateral side of the foot to the medial side of the foot and forward where push off from the ground occurs at the big toe area (on the medial side of the foot). This process is called "pronation." The grooves 502*a* and/or 504*a* help reduce overall stiffness of the sole structure 500 and improve the comfort and feel during a step cycle as weight shifts from the lateral side to the medial side of the foot. This results in a more natural motion and feel during a step cycle.

Figure 5B:
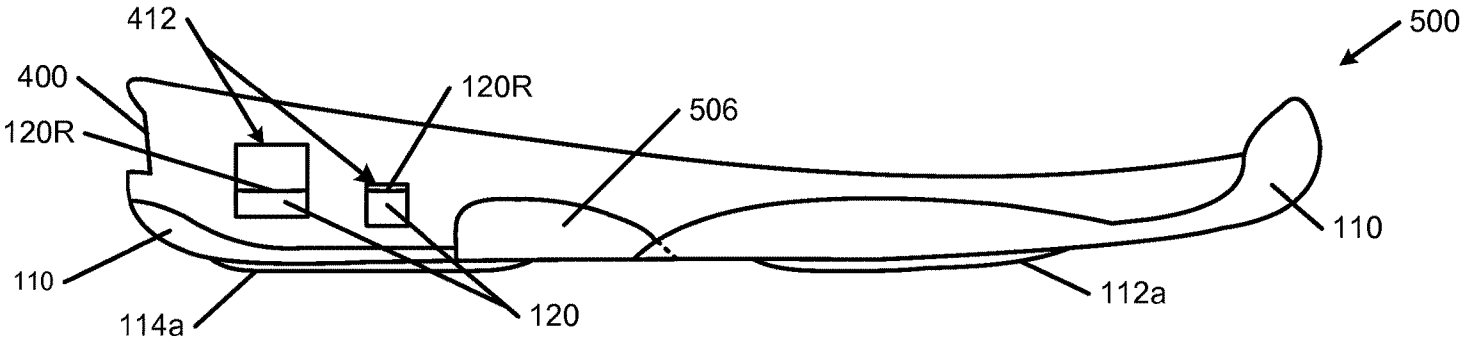
Figure 5C:
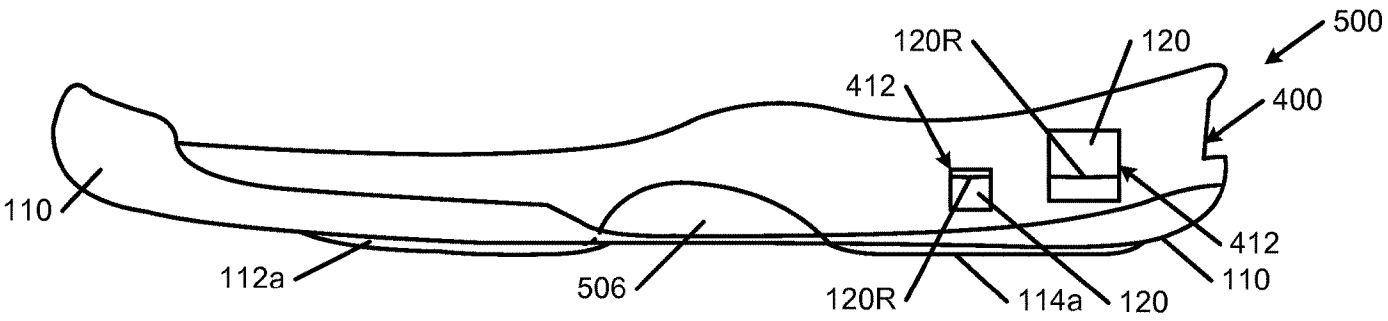
Figure 5D:
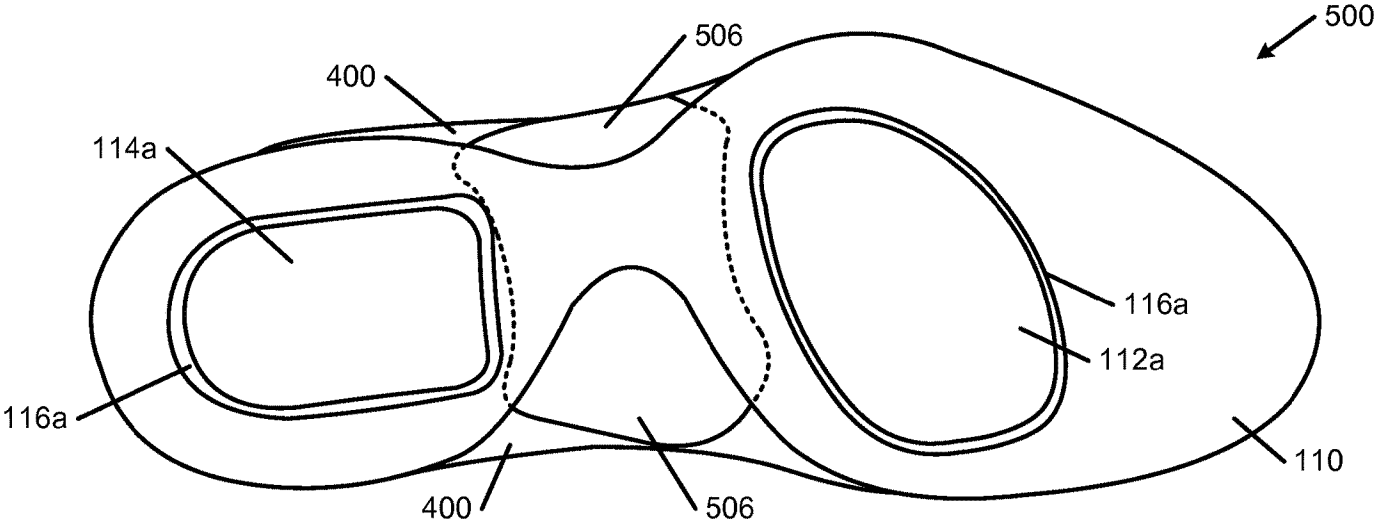

FIGS. 5B and 5C additionally show the cutout areas 412 of the midsole component 400 extending through the side walls of the midsole component 400, thereby opening a through hole or window to the interior of the midsole component 400 where the rearfoot fluid-filled bladder system 120 is mounted. In this manner, the rearfoot fluid-filled bladder system 120 can be partially seen from the exterior of the sole structure 500. If desired, the fluid-filled bladder system 120 can be colored different from other features of the sole structure so that the bladder system 120 stands out and is more clearly visible from the outside of the sole 500 through cutout areas 412. The exterior areas of these through holes can take on any desired size, shape, and features without departing from this invention. In addition to providing a window into and an interesting aesthetic appearance to the sole structure 500, the through holes can help lighten the midsole component 400 somewhat and help control and/or fine tune the flexibility and support features of the midsole component 400.

If desired, in accordance with at least some examples of this invention, the outsole component 110 may be made from a transparent or translucent material (or a partially transparent or translucent material, e.g., a colored but clear or substantially clear polymer component). When made in this manner, color from the underlying midsole component 400, arch support member 506, and/or the fluid-filled bladder systems can be seen through the bottom surface of the outsole component 110. If desired, the bottom surfaces of one or more of the fluid-filled bladder systems 120, 130 may be made from material having a different color from that of the bottom surface of the midsole component 400 so that the fluid-filled bladders 120, 130 and the midsole component 400 are distinguishable from one another through the bottom of the outsole component 110 (e.g., assuming that the fluid-filled bladders 120, 130 are mounted on the outsole component 110 through openings 140*a*, 140*b* extending completely through the midsole component 400). For example, in the view shown in FIG. 5D, the color(s) in projection areas 112*a* and 114*a* may be different from the color(s) at locations of the outsole component 110 directly covering the midsole component 400 due to the ability to see the bottom of the fluid-filled bladders 120, 130 through the outsole component 110. Likewise, if desired, the arch support member 506 may be made from material having a different color (at least on its bottom surface) from that of the bottom surface of the midsole component 400 so that the support member 506 and the midsole component 400 are distinguishable from one another through the bottom of the outsole component 110. As a more specific example, in the view shown in FIG. 5D, the color(s) in at the outsole area covering the arch support member 506 may be different from the color(s) at locations of the outsole component 110 directly covering the midsole component 400 due to the ability to see the bottom of the support member 506 through the outsole component 110. The bottom surfaces of the arch support member 506 and the fluid-filled bladders in projection areas 112*a* and 114*a* may have the same or different colors.

Figure 5E:
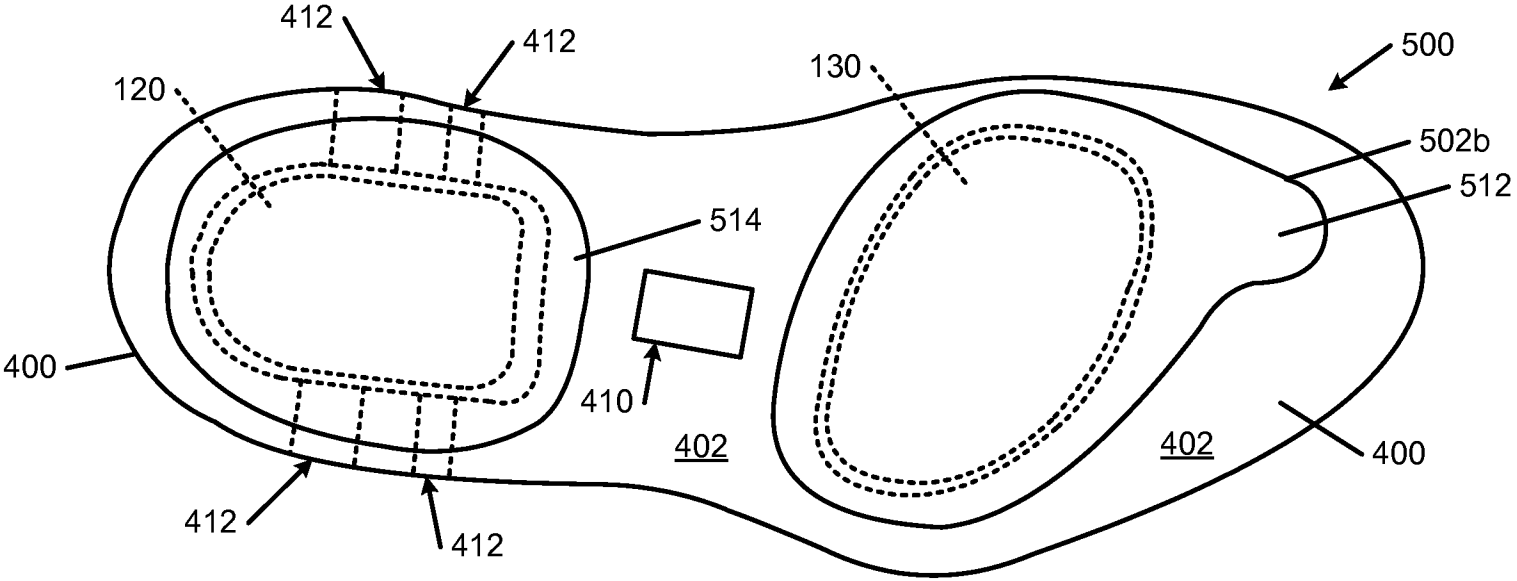

FIG. 5E illustrates other features of example plate members 512 and 514 that may be used in place of plate components 502 and/or 504 described above. More specifically, these illustrated plate components 512 and 514 eliminate the relatively large groove areas 502*a* and 504*a* shown in the plate constructions 502 and 504 of FIG. 5A. As alternatives, if desired, the forefoot plate 512 of FIG. 5E could be used with the rearfoot plate 504 of FIG. 5A or the forefoot plate 502 of FIG. 5A could be used with the rearfoot plate 514 of FIG. 5E. Notably, the example forefoot plate structure 512 of FIG. 5E includes an extended big toe support area 502*b*, although this projection could be omitted (or the overall top edge of the plate could be made to curve more smoothly) without departing from this invention.

Figure 6A:
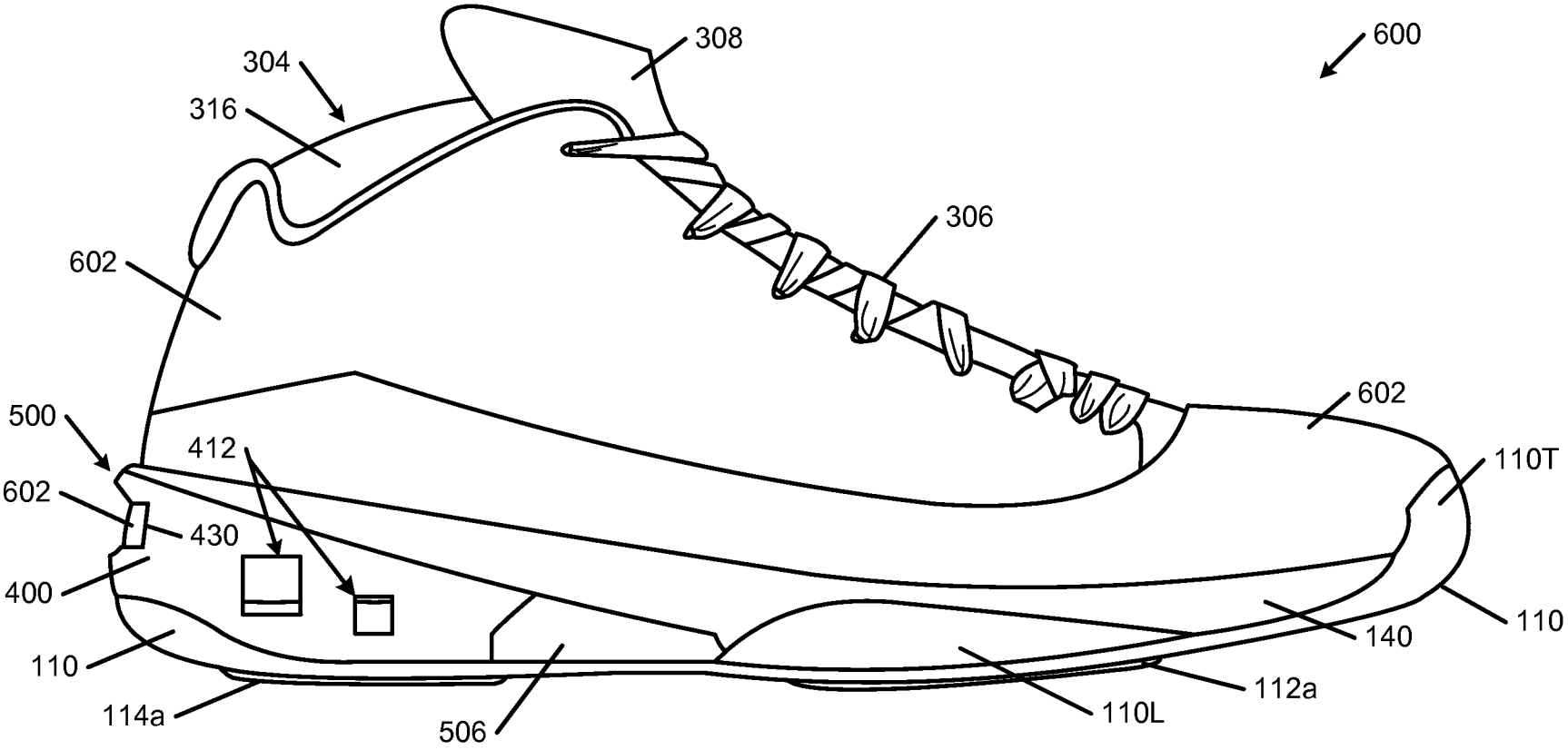
FIGS. 6A and 6B show various views of an article of footwear including a sole structure according to at least some examples of this invention.
Figure 6B:
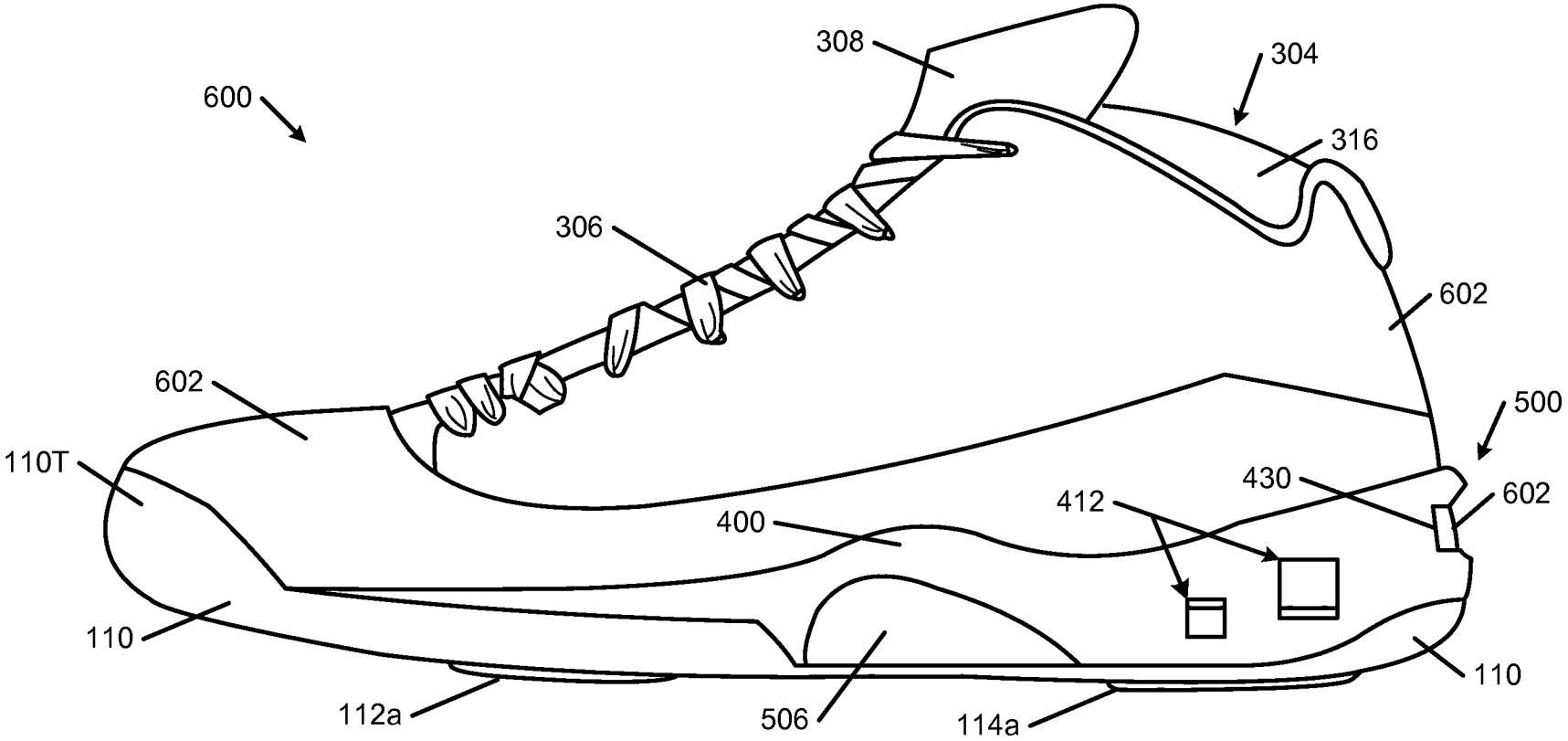

FIGS. 6A and 6B illustrate lateral and medial side views, respectively, of an article of footwear 600 including sole structures 500 like those of FIGS. 5A through 5E incorporated into it. The footwear 600 includes an upper component 602, which may be made from one or more component parts, engaged with the sole structure 500. The upper 602 and sole structure 500 may have any of the desired features and/or combination of features described above, including the features and/or combination of features of the upper member 302 described above in conjunction with FIGS. 3A through 3D.

The midsole component 400 in the example sole structure 500 shown in FIGS. 6A and 6B further includes one or more rear heel through holes 430 through which a portion of the upper 602 is exposed. In addition to providing an interesting aesthetic appearance to the sole structure 500, the rear through hole(s) 430 can help lighten the midsole component 400 somewhat and help control and/or fine tune the flexibility and support features of the midsole component 400.

Figure 7:
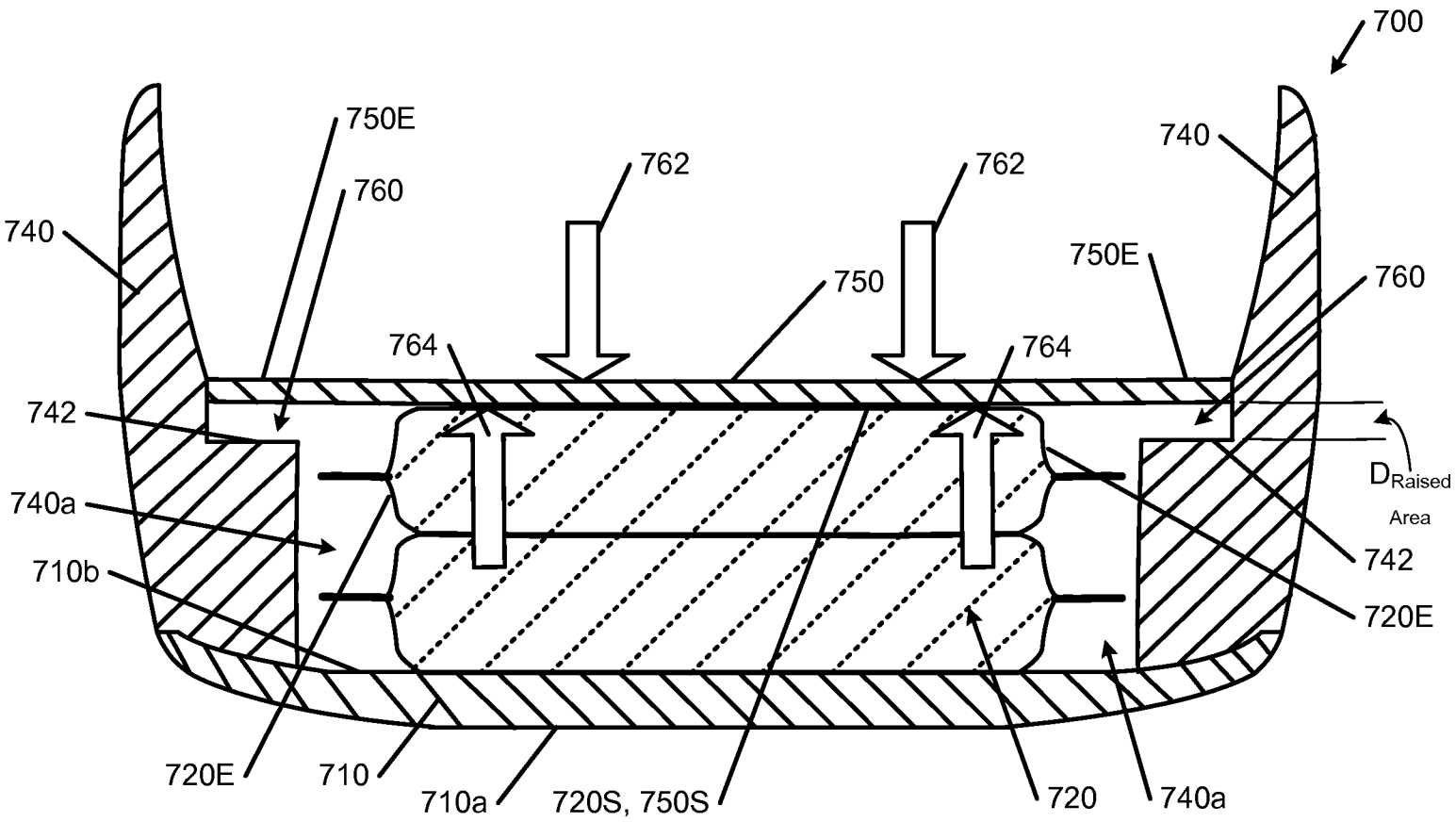
FIG. 7 includes a cross sectional view of a sole structure according to another example of this invention.

FIG. 7 illustrates another example sole structure 700 in accordance with at least some aspects of this invention. As shown in FIG. 7, this example sole structure 700 includes an outsole component 710 including an exterior major surface 710*a* and an interior major surface 710*b*. The outsole component 710 may be made of any desired material, including the materials described above for outsole component 110 (such as transparent or translucent materials) and/or conventional outsole materials as are known and used in this art. While not shown in the example structure 700 of FIG. 7, if desired, the interior major surface 710*b* of the outsole component 710 may include one or more raised areas (like raised ribs 116) defining a space for receiving one or more fluid-filled bladder systems, e.g., like the double stacked fluid-filled bladder system 720 shown in FIG. 7.

The interior major surface 710*b* of the outsole component 710 is engaged with a midsole component 740, e.g., by adhesives or cements. The midsole component 740 of this example may have any desired characteristics or properties, including any of the characteristics or properties of the midsole components 140 and 400 described above. This example midsole component 740 includes at least one receptacle area 740*a*, which may be any desired size or shape (e.g., located in a forefoot area for supporting at least some of a wearer's metatarsal head and/or toes, located in a rearfoot area for supporting a wearer's heel, a single fluid-filled bladder that extends from the heel area to the midfoot or forefoot area of the sole structure, etc.). A base surface 742 may at least partially surround the receptacle area 740*a*, and at least some portions of this base surface 742 may be recessed somewhat into the top major surface of the midsole component 740. If desired, the midsole component 740 may include separate forefoot and rearfoot receptacle areas 740*a*. Also, the receptacle areas 740*a* may constitute complete through holes as shown in FIG. 7, or they may constitute blind holes (e.g., in which a layer of the midsole component 740 or midsole material is provided in the bottom of receptacle area 740*a* covering the interior major surface 710*b* of the outsole component 710).

As noted above, a fluid-filled bladder system 720 is received in the receptacle area 740*a*. In contrast to the structures described above in conjunction with FIGS. 1A through 6B, in this example sole structure 700, an upper surface 720S of the fluid-filled bladder system 720 extends above the base surface 742 of the midsole component 740 when the sole structure 700 is in an uncompressed condition. The distance or maximum height in an uncompressed state ($D_{Raised\ Area}$) may range from about 1-15 mm, and in some examples, from about 1.5 to 12 mm or even 1.75 to 10 mm. The raised area height $D_{Raised\ Area}$ may be the same or different at the forefoot and rearfoot areas, and this height may vary around the perimeter of the receptacles.

Finally, as shown in FIG. 7, this example sole structure 700 includes a rigid plate component 750 having a bottom major surface 750S overlying and engaging the upper surface 720S of the fluid-filled bladder system 720. The rigid plate component 750 may have the structure and/or other characteristics of any of the rigid plate components 150, 502, and/or 504 described above, including the various groove structures 502*a*, 504*a* described above. While not a requirement, if desired, the rigid plate component 750 may be fixed to the upper surface 720S of the fluid-filled bladder system 720, e.g., by cements or adhesives, by mechanical connectors, etc. As shown in FIG. 7, perimeter edges 750E of the rigid plate component 750 extend beyond edges 720E of the fluid-filled bladder system 720 and over the base surface 742 of the midsole component 740. Notably, however, in this example structure 700, the bottom major surface 750S of the rigid plate component 750 does not contact the base surface 742 of the midsole component 740 when the sole structure 700 is in an uncompressed condition. Rather, the perimeter edges 750E of the rigid plate component 750 "hover over" the base surface 742 when the sole structure 700 is in an uncompressed condition, thereby defining a space 760 between the perimeter edges 750E and the base surface 742. If desired, however, a portion of the base surface 742 (e.g., the extreme outer edges) may extend up to and contact the bottom major surface 750S of the rigid plate component 750 when the sole structure 700 is in an uncompressed condition, while still leaving some portion of space 760 in the structure 700.

The space 760 provides different/additional impact force attenuation properties to the sole structure 700 of this example construction. When a downward force 762 is applied to the rigid plate component 750 (e.g., from a user's step, from landing a jump, etc.), the rigid plate component 750 will displace downward compressing the fluid-filled bladder system 720. The gap 760 allows this movement to occur without the need to additionally compress any midsole foam material, thereby resulting in a somewhat softer, more comfortable feel. If necessary, the base surface 742 may act as a "stop" system to stop or slow compression of the fluid-filled bladder system 720 and prevent over compression of the system. Because the fluid-filled bladder system 720 of this example sole structure 700 includes a gas under pressure in the sealed bladder envelope, the fluid-filled bladder system 720 quickly rebounds and attempts to return toward its original configuration. This action applies an upward force on the rigid plate component 750, which is shown in FIG. 7 by arrows 764. The overall sole structure 710 provides a comfortable, soft feel for the wearer, excellent impact force attenuation, responsiveness, and a desired propulsive return or rebound force 764 to the wearer's foot.

Sole structures 700 of the types illustrated in FIG. 7 may include a single fluid-filled bladder system (e.g., in the forefoot, in the rearfoot, covering at least some areas of both the forefoot and rearfoot, a full foot supporting bladder, etc.). Alternatively, if desired, sole structures of the types illustrated in FIG. 7 may include multiple fluid-filled bladder systems (e.g., vertically stacked, horizontally arranged, etc.) and/or multiple rigid plate components, e.g., of the types illustrated in FIGS. 5A through 5E. As yet another alternative, if desired, sole structures of the types illustrated in FIG. 7 may include multiple fluid-filled bladder systems and a single rigid plate component, e.g., of the types illustrated in FIGS. 1A through 2C. As still another alternative, if desired, in any of the sole structures described above, a single fluid-filled bladder system may have multiple rigid plate components covering it. Any desired numbers and combinations of fluid-filled bladder systems and rigid plate components may be used without departing from this invention, including more than two fluid-filled bladder systems and plate components.

Figure 8A:
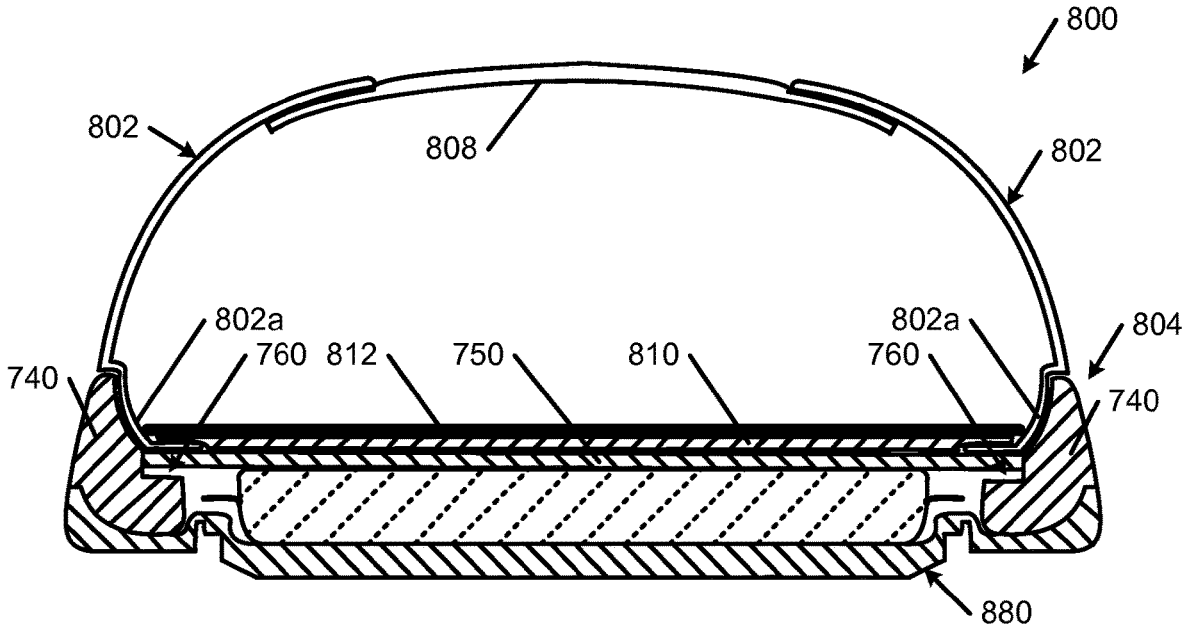
FIGS. 8A and 8B include cross sectional views of portions of an article of footwear according to another example of this invention.
Figure 8B:
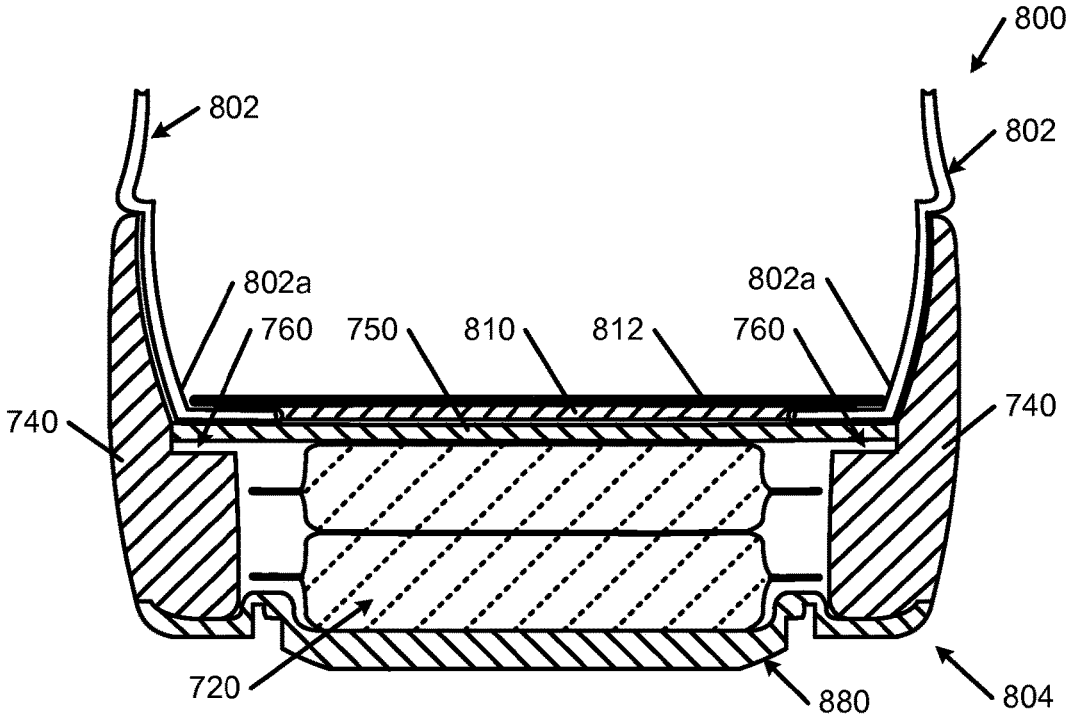

FIGS. 8A and 8B illustrate example cross sectional views of an article of footwear 800 incorporating the impact-attenuating space 760 feature of sole structure 700 described above in conjunction with FIG. 7. The example upper 802 shown in FIGS. 8A and 8B may be the same as or similar to those described above in conjunction with FIGS. 3A through 3D. The structure shown in FIG. 8A may be provided, for example, in a forefoot area of a footwear structure (e.g., as described above in conjunction with FIGS. 1A through 1D, 3C, and 4A through 6B), and the structure shown in FIG. 8B may be provided, for example, in a rearfoot area of a footwear structure (e.g., as described above in conjunction with FIGS. 1A through 1C, 1E, and 3D through 6B). Also, if desired, the stacked bag fluid-filled bladder system 720 shown in FIG. 8B may be replaced with a single fluid-filled bladder system, e.g., as shown in FIG. 2B. Also, the outsole structure 880 shown in FIGS. 8A and 8B includes projection areas and raised rims more akin to the outsole structures 110 described above in conjunction with FIGS. 1A through 6B, although an outsole construction like that shown in FIG. 7 (e.g., one without the outsole projection areas) may be used under at least some of the fluid-filled bladder areas without departing from this invention.

The upper 802 may have any desired construction and may be made from any desired number of parts and/or materials (connected in any desired manner), including conventional constructions, parts, and/or materials as are known and used in the footwear art. The upper 802 may be designed to provide regions with desired characteristics, such as regions with increased durability and/or abrasion resistance, regions of increased breathability, regions of increased flexibility, regions with desired levels of support, regions with desired levels of softness or comfort, etc. Like the example shown in FIGS. 3A and 3B, the upper 802 may include an ankle opening and one or more securing systems (such as laces, straps, buckles, etc.) for securing the footwear 800 to a wearer's foot. A tongue member 808 can be provided over the instep area of the shoe 800 to help moderate the feel of the securing system at the wearer's foot.

As further shown in FIGS. 8A and 8B, in this example structure 800, the lower edges 802*a* of the upper 802 are connected together by a strobel member 810 that closes off the bottom of the overall upper 802. This connection may be made, for example, by sewing the upper edges 802*a* to the strobel member 810, or in any other desired manner, e.g., as is known and used in the art. The strobel member 810 and upper 802 of this example construction form a foot-receiving chamber accessible through the ankle opening. The upper 802 and strobel member 810 may be engaged with the sole structure 810, e.g., by gluing or otherwise securing the upper 802 and strobel 810 to the midsole component 740 (e.g., to the side and/or top surfaces of the midsole component 740) and/or the rigid plate component 750 (e.g., to its top surface). As further shown in FIGS. 8A and 8B, the foot-receiving chamber of the upper 802 further may include a sock liner 812. While it may be secured within the foot-receiving chamber, the sock liner 812 may simply lie atop the strobel member 810 (and thus may be readily removable from the foot-receiving chamber). The sock liner 812 may be made from a soft, comfortable material (e.g., a foam material), to provide a soft, comfortable surface for engaging the wearer's foot.

Alternatively, if desired, one or more of the strobel member 810, the sock liner 812, and/or the tongue member 808 may be replaced by an interior bootie member or other structure for receiving the wearer's foot. As another option, e.g., like the structure shown in FIGS. 3A and 3B, the area around the ankle opening of this example upper 802 may be provided with a soft, comfortable fabric element 316, to make a comfortable fit to the wearer's foot.

Figure 9A:
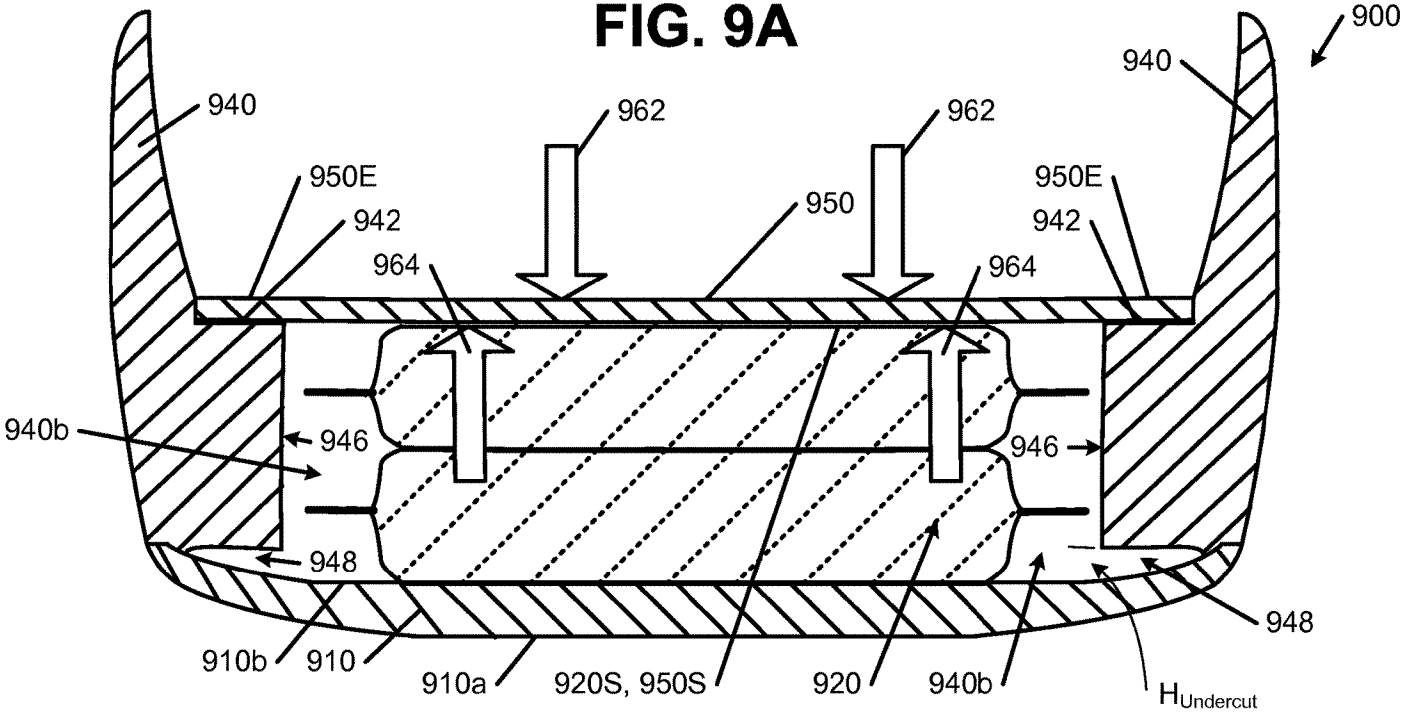
FIGS. 9A and 9B include cross sectional views of portions of sole structures according to other examples of this invention.
Figure 9B:
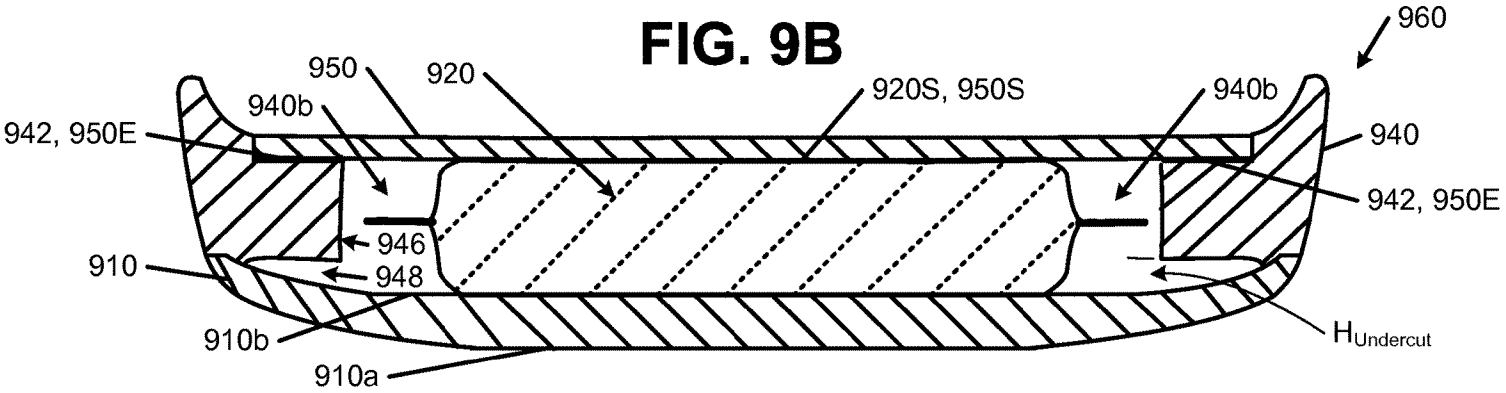

FIGS. 9A and 9B illustrate rearfoot and forefoot cross sectional views, respectively, of another example sole structure construction in accordance with at least some examples of this invention. These rearfoot and forefoot structures may be used in a single footwear construction, if desired. Alternatively, either of these structures may be used individually and/or in conjunction with any of the other sole structure components or constructions described above in conjunction with FIGS. 1A through 8B. More detailed descriptions of these constructions are provided below.

FIG. 9A provides an illustration of a heel or rearfoot portion of a sole structure 900 in accordance with this example aspect of this invention. As shown, this sole structure 900 includes an outsole component 910 that has an exterior major surface 910*a* and an interior major surface 910*b*. In this illustrated example structure 900, the outsole component 910 does not include the projection areas described above, e.g., with respect to FIGS. 1A through 6B, 8A, and 8B, but a projection area could be provided, if desired.

A midsole component 940 is engaged with the interior major surface 910*b* of the outsole component 910. As illustrated in FIG. 9A, this example midsole component 940 includes an opening 940*b* defined in it (which may be a blind hole or a through hole). A rearfoot fluid-filled bladder system 920 is located at least partially within the opening 940*b* and in this example is engaged with the interior major surface 910*b* of the outsole component 910 within the opening 940*b*. A rigid plate member 950 at least partially overlays a top surface 920S of the fluid-filled bladder system 920 such that the top surface 920S of the fluid-filled bladder system 920 and the bottom surface 950S of the plate member 950 are in contact with one another (and optionally fixed together, e.g., by adhesives) when this portion of the sole structure 900 is in an uncompressed condition.

FIG. 9A further illustrates that in this example structure 900, the perimeter edges 950E of the rigid plate member 950 extend over (and optionally contact) a base surface 942 provided on the upper major surface of the midsole component 940. If desired, the rigid plate member 950 may be fixed to the midsole component 940 at this perimeter area, e.g., by adhesives.

As further shown in FIG. 9A, a bottom surface of the midsole component 940 adjacent the interior wall 946 of the opening 940*b* includes an undercut area 948 that defines a gap between at least a portion of the bottom surface of the midsole component 940 and the interior major surface 910*b* of the outsole component 910. While the undercut area 948 may define any desired size, shape, and/or volume without departing from this invention, in this illustrated example structure, the undercut area 948 is generally disk shaped and has a tallest or maximum height (H Undercut) within a range of 1 to 15 mm when this portion of the sole structure 900 is in an uncompressed condition, and in some examples, a maximum height of 1.5 to 12 mm or even 1.75 to 10 mm when this portion of the sole structure 900 is in an uncompressed condition. Also, the undercut area 948 may extend completely around an interior perimeter area of the opening 940*b* or partially around the interior perimeter area of the opening 940*b*. As another example, if desired, the undercut area 948 may be discontinuous around the interior perimeter of the opening 940*b* (e.g., present in plural, separated segments).

In use, when a compressive force 962 is applied between the rigid plate member 950 and the exterior major surface 910*a* of the outsole component 910, the undercut 948 or gap height ($H_{Undercut}$) reduces in height (e.g., at least partially collapses). If necessary, the undercut area 948 also can provide room for deflection and changes in shape of the bladder 920 and/or the midsole component 940. The fluid-filled bladder 920 provides rebound energy, responsiveness, and the feel of a propulsive force.

FIG. 9B shows a similar sole structure portion 960, but sized and shaped more for use in a forefoot area of an overall sole structure and/or shoe. The same reference numbers are used in FIG. 9B as in 9A to represent the same or similar parts, so the corresponding description is omitted. In this illustrated example structure 960, the outsole component 910 does not include the projection areas described above, e.g., with respect to FIGS. 1A through 6B, 8A, and 8B, but a projection area could be provided, if desired. Also, in this illustrated example, while the undercut area 948 may define any desired size, shape, and/or volume without departing from this invention, in this illustrated example structure, the undercut area 948 is generally disk shaped and has a tallest or maximum height ($H_{Undercut}$) within a range of 1 to 15 mm when this portion of the sole structure 960 is in an uncompressed condition, and in some examples, a maximum height of 1.5 to 12 mm or even 1.75 to 10 mm when this portion of the sole structure 960 is in an uncompressed condition. Also, the undercut area 948 may extend completely around an interior perimeter area of the opening 940*b* or partially around the interior perimeter area of the opening 940*b*. As another example, if desired, the undercut area 948 may be discontinuous around the interior perimeter of the opening 940*b* (e.g., present in plural, separated segments). The sole structure 960 of FIG. 9B can function in a manner similar to that described above for the sole structure 900 of FIG. 9A.

FIGS. 9A and 9B show the undercut regions 948 located at a bottom surface of the midsole component 940 around the perimeter of the opening 940*b* (i.e., with the opening to the undercut region 948 provided in the interior wall 946 of the opening 940*b* of the midsole component 940). This is not a requirement. Rather, if desired, the undercut region 948 could be provided at other locations along the interior wall 946 of the midsole component 940, e.g., such that midsole material defines both the top and bottom surfaces of the undercut region 948. As some more specific examples, if desired, the undercut region 948 could be provided at the center of the interior wall 946 or in the bottom half of the interior wall 946.

The undercut area(s) 948 and gap(s) described above in conjunction with FIGS. 9A and/or 9B may be used in any of the sole structures described above either in combination with any of the sole structures described above or as a replacement for at least some of the sole structures described above. Additionally, the undercut area(s) 948 and gap(s) described above in conjunction with FIGS. 9A and/or 9B and the sole structures containing such undercut area(s) 948 and gap(s) may be used in conjunction with any desired upper construction, including the upper constructions described above. As yet additional alternatives, if desired, the sole structure portions of FIG. 9A or 9B can be used individually in a given sole structure or shoe, e.g., with other conventional impact force attenuating components provided in other areas or regions of the sole structure or shoe.

Figure 10A:
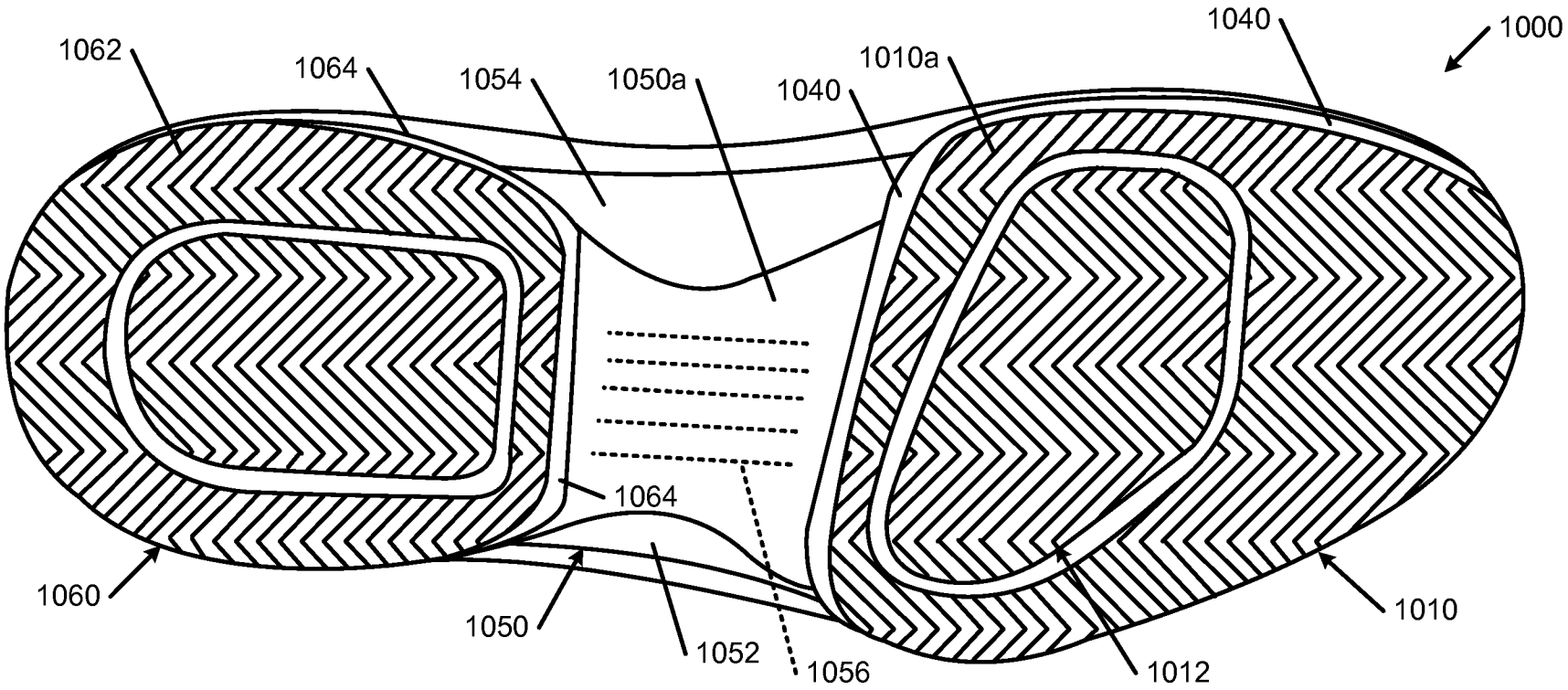
FIGS. 10A through 10C include various views of another example sole structure and shoe according to some examples of this invention.
Figure 10B:
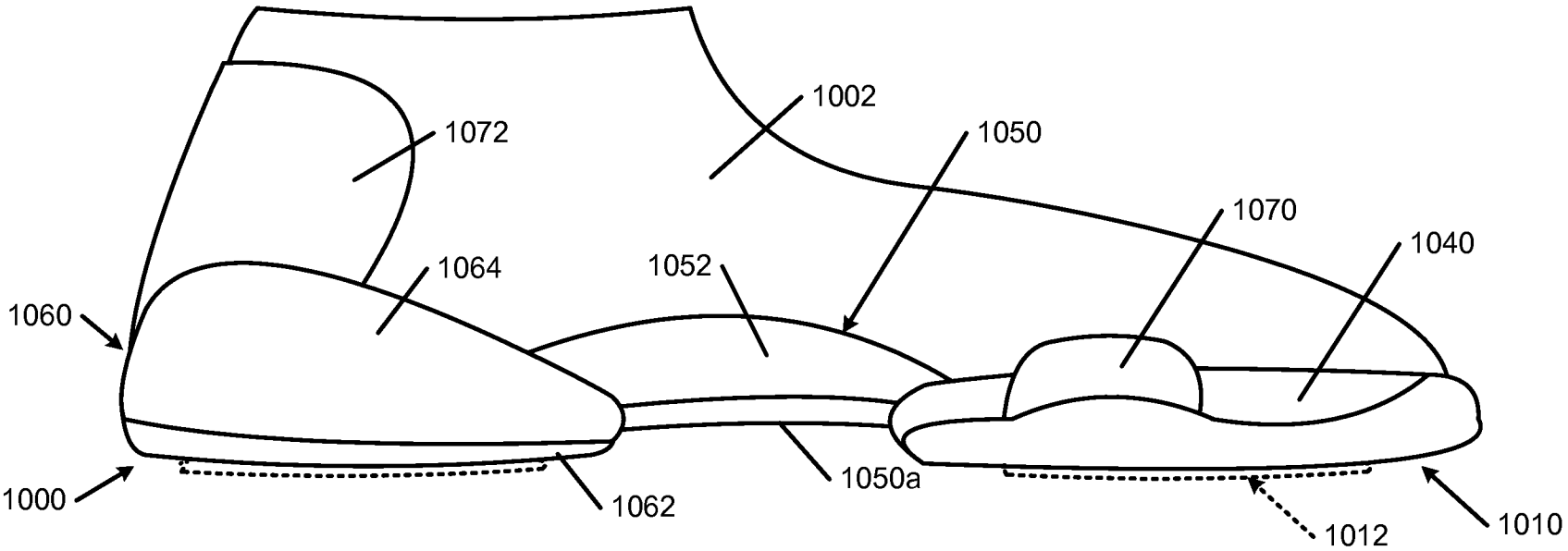
Figure 10C:
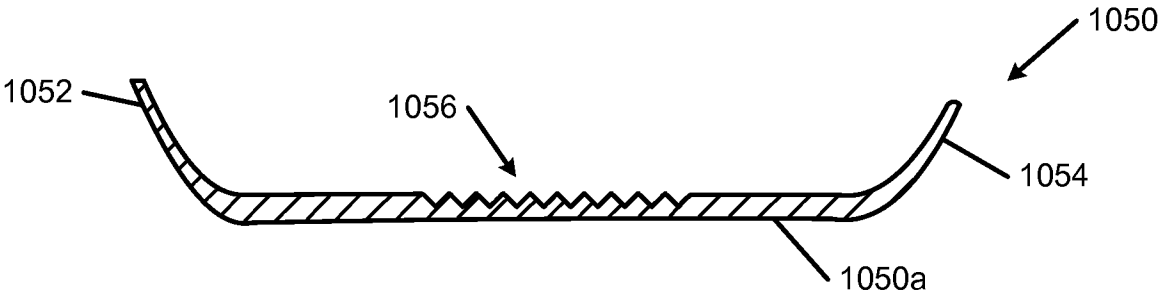

FIGS. 10A through 10C illustrate features of additional sole structures in accordance with at least some examples of this invention. FIG. 10A provides a bottom view, FIG. 10B provides a lateral side view, and FIG. 10C provides a cross sectional view of the plate member 1050. In the example sole structure 1000 shown in these figures, the forefoot midsole and outsole components are separated from the rearfoot midsole and outsole components as will be described in more detail below.

More specifically, as shown in FIGS. 10A and 10B, this example sole structure 1000 includes a forefoot outsole component 1010 including an exterior major surface 1010*a* and an interior major surface located opposite the exterior major surface (and interior to the overall sole structure 1000). A forefoot midsole component 1040 is engaged with the interior major surface of the forefoot outsole component 1010. This forefoot midsole component 1040 includes a forefoot receptacle defined therein (e.g., a through hole or a blind hole), and this receptacle may take on any of the forms, structures, and/or characteristics described above. A forefoot fluid-filled bladder system may be provided at least partially within the forefoot receptacle, e.g., in any of the manners described above. This forefoot outsole component 1010 and its various component parts described above may take on any of the general forms, structures, and/or characteristics of the outsole components described above in conjunction with FIGS. 1A through 9B, including a projection area 1012, as shown in broken lines in FIG. 10B.

As shown in FIGS. 10A and 10B, this forefoot outsole component 1010 includes a rigid plate member 1050, and this rigid plate member 1050 includes a portion that at least partially overlays the forefoot-fluid filled bladder system in the interior of the midsole component 1040, e.g., in any of the various manners described above. In contrast to the other sole structures described above, however, in this sole structure 1000, the rigid plate member 1050 includes a portion located under the forefoot outsole component 1010 (e.g., at least partially overlaying the forefoot midsole component 1040 and the fluid-filled bladder contained in the receptacle therein) and a portion located outside the forefoot outsole component 1010. Notably, as shown in the example structures of FIGS. 10A and 10B, a bottom surface 1050*a* of the rigid plate member 1050 is exposed and forms a bottom surface of the overall sole structure 1000 in an arch area of the sole structure (i.e., at a location rearward of the forefoot outsole component 1010).

The sole structure 1000 of this illustrated example further includes a rearfoot impact-attenuation system 1060 for attenuating ground reaction forces in a heel area of the sole structure 1000. In some example sole structures 1000 in accordance with aspects of this invention, this rearfoot impact-attenuation system 1060 may take on a conventional form (e.g., different from the various rearfoot systems described above in conjunction with FIGS. 1A through 9A), such as impact-attenuation systems including one or more fluid-filled bladders (without a rigid plate covering member), impact-attenuation systems including one or more foam components, impact-attenuation systems including two or more foam columnar elements, impact-attenuation systems including one or more mechanical shock absorbing elements, etc.

Alternatively, as shown in FIGS. 10A and 10B, however, in this example sole structure 1000, the rearfoot impact-attenuation system 1060 includes a rearfoot outsole component 1062 separate from the forefoot outsole component 1010*a* and a rearfoot midsole component 1064 separate from the forefoot midsole component 1040. The forefoot and rearfoot outsole components and the forefoot and rearfoot midsole components are separated from one another in this example sole structure 1000 by the exposed portion of the rigid plate member 1050. As shown in FIG. 10A, in this example sole structure 1000, a rear portion of the rigid plate member 1050 extends over and engages an upper surface of at least one portion of the rearfoot impact-attenuation system 1060 (e.g., overlays and/or engages the top surface of at least one of the rearfoot midsole component 1064 or the rearfoot outsole component 1062).

As yet another option or alternative, if desired, the rearfoot impact-attenuation system 1060 may take on the general form and structure described above with respect to FIGS. 1A through 9A. More specifically, the rearfoot midsole component 1064 (which is separate from the forefoot midsole component 1040) is engaged with an interior major surface of the rearfoot outsole component 1062, and this rearfoot midsole component 1064 may include a rearfoot receptacle (a through hole or a blind hole) defined therein for receiving a rearfoot fluid-filled bladder system. In this example sole structure 1000, in addition to including a first rigid plate portion at least partially overlaying the forefoot fluid-filled bladder system, the rigid plate member 1050 further includes a second rigid plate portion at least partially overlaying (and optionally completely covering) the rearfoot fluid-filled bladder system provided in rearfoot midsole component 1064. In other words, the construction and/or parts of sole structure 1000 may be similar to the construction and/or parts of sole structure 100 of FIG. 1A (and/or the various other embodiments and variants described above in FIGS. 1A through 9B), but the front and rear midsole and outsole structures are separated at the arch area and divided into two separate parts. This construction leaves the bottom surface 1050*a* of the rigid plate member 1050 exposed and forming a bottom surface of the sole structure 1000 in an arch area between the forefoot outsole component 1010 and the rearfoot outsole component 1062.

As further shown in FIGS. 10B and 10C, this example sole structure 1000 includes a lateral side support component 1070 extending along a lateral forefoot side of the sole structure 1000. This example lateral side support component 1070 includes at least a portion located between the forefoot outsole component 1010 and the forefoot midsole component 1040. The lateral side support component 1070 may wrap around a portion of the upper 1002 and provides additional support, e.g., along the lateral forefoot side or fifth metatarsal area of the shoe, for athletic use, such as additional support during quick turns or cutting moves while running, etc.

FIGS. 10A through 10C show additional details of rigid plate members 1050 that may be used in this sole structure 1000 and/or other sole structures in accordance with examples of this invention (e.g., in the structures of FIGS. 1A through 9B). For example, as shown in these figures, the rigid plate member 1050 may include a lateral side edge 1052 and a medial side edge 1054 extending upward from the bottom surface 1050*a* of the rigid plate member 1050 at least in the arch area of the sole structure 1000. These side edges 1052 and 1054 help provide a stable support for the wearer's foot.

The rigid plate member 1050 of this example structure further includes a plurality of rib elements 1056 formed therein, and in this illustrated example, the rib elements 1056 are parallel or substantially parallel and extend in a generally front-to-rear direction of the sole structure 1000. The rib elements 1056 add stiffness to the plate member 1050 in the arch area and help reduce the overall weight of the plate member 1050. Any desired number of rib elements 1056 may be provided without departing from this invention, including rib elements 1056 of any desired size and/or cross sectional shape. Also, while shown in the interior surface in FIGS. 10A and 10C, if desired, some or all of the rib elements 1056 could be provided on the exterior surface of the plate member 1050 without departing from this invention. The rigid plate member 1050 may be somewhat curved, if desired, e.g., in the front-to-back and/or side-to-side directions, e.g., as described above.

FIGS. 10A and 10B further show that the sole structure 1000 may be engaged with an upper 1002 to form an article of footwear. The upper 1002 may have any desired construction and/or materials without departing from this invention, including the constructions and/or materials described above and/or other constructions and materials as are known and used in the art. A heel counter 1072 for supporting the wearer's heel also is shown in the example structure of FIG. 10B.

The various example structures described above in conjunction FIGS. 1A through 10C utilize sealed fluid-filled bladders within the receptacles defined a midsole component. Fluid-filled bladders used in examples of this invention include a fluid, such as a gas, under ambient pressure or under an elevated pressure (above standard or atmospheric pressure). Such fluid-filled bladders are advantageous because they can provide excellent impact force attenuation, responsiveness, and a propulsive return or rebound force to the wearer's foot. The rigid plates help better return this force to the wearer (e.g., as compared to a softer overlay material). If desired, however, in at least some example structures in accordance with this invention, one or more of the fluid-filled bladders in the structures described above may be replaced by a foam material, such as polyurethane foams, ethylvinylacetate foams, and the like. Foams of these types may be at least partially overlain with a rigid plate member, e.g., in the various manners described above.

Finally, several of the structures described above included rigid plate moderated fluid-filled bladders located in both the forefoot and rearfoot areas. Aspects of this invention are not limited to such structures. For example, if desired, a rigid plate moderated fluid-filled bladder system (or foam system) could be provided only in the rearfoot area of the sole structure, optionally with other impact force attenuation systems provided in other areas of the sole structure, such as in the forefoot or arch area, including conventional impact force attenuation systems provided in these other areas (e.g., polymeric foam materials, fluid-filled bladder systems, mechanical shock absorbing systems, etc.). As another example, if desired, a rigid plate moderated fluid-filled bladder system (or foam system) could be provided only in the forefoot area of the sole structure, optionally with other impact force attenuation systems provided in other areas of the sole structure, such as in the rearfoot or arch area, including conventional impact force attenuation systems provided in these other areas (e.g., polymeric foam materials, fluid-filled bladder systems, mechanical shock absorbing systems, etc.). As yet additional alternatives, if desired, additional rigid plate moderated fluid-filled bladder systems (or foam systems) may be provided in the overall sole structure, e.g., such that the forefoot area includes two or more separate rigid plate moderated fluid-filled bladder systems and/or such that the rearfoot area includes two or more separate rigid plate moderated fluid-filled bladder systems. A rigid plate moderated fluid-filled bladder system also could be provided in the midfoot or arch area, if desired, and/or at least one of the forefoot or rearfoot rigid plate moderated fluid-filled bladder systems may extend at least partially into the midfoot or arch area.

III. Conclusion

The present invention is disclosed above and in the accompanying drawings with reference to a variety of embodiments. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A sole structure for an article of footwear, comprising:

an outsole component including an exterior major surface and an interior major surface, wherein the exterior major surface includes a forefoot projection area and a rearfoot projection area, wherein the forefoot projection area is at least partially surrounded by and projects beyond a first main outsole surface area, wherein the forefoot projection area is connected to the first main outsole surface area by a first flexible web member, wherein the rearfoot projection area is at least partially surrounded by and projects beyond a second main outsole surface area, and wherein the rearfoot projection area is connected to the second main outsole surface area by a second flexible web member;

a midsole component engaged with the interior major surface of the outsole component, wherein the midsole component includes a forefoot opening and a rearfoot opening, wherein the forefoot opening is located proximate to the forefoot projection area, and wherein the rearfoot opening is located proximate to the rearfoot projection area;

a forefoot fluid-filled bladder system having a bottom surface fixed to the interior major surface of the outsole component at the forefoot projection area and a top surface;

a rearfoot fluid-filled bladder system having a bottom surface fixed to the interior major surface of the outsole component at the rearfoot projection area and a top surface; and a rigid plate system overlaying a top surface of the midsole component, the rigid plate system including an arched spring plate made from a rigid, non-foam plastic material and having (a) a first metatarsal head support portion configured to support a first metatarsal head area of a wearer's foot, (b) a fifth metatarsal head support portion configured to support a fifth metatarsal head area of a wearer's foot, and (c) a rear heel support portion configured to support a calcaneus bone of a wearer's foot, wherein the arched spring plate is arched in at least one of a heel-to-toe direction or a medial side-to-lateral side direction of the sole structure, wherein a bottom surface of the arched spring plate is fixed to the top surface of the forefoot fluid-filled bladder system and to the top surface of the rearfoot fluid-filled bladder system, and wherein the arched spring plate is configured in the sole structure such that: (a) a downward force on the arched spring plate applied by a wearer's weight on the sole structure flattens out the arched spring plate and (b) when the downward force is reduced or released as the wearer's foot is lifted from a contact surface, the arched spring plate applies a rebound or return force to the wearer's foot.

2. A sole structure for an article of footwear, comprising:

an outsole component including an exterior major surface and an interior major surface, wherein the interior major surface includes a forefoot recessed area and a rearfoot recessed area, wherein the exterior major surface includes a forefoot projection area corresponding to the forefoot recessed area and a rearfoot projection area corresponding to the rearfoot recessed area, wherein the forefoot projection area is at least partially surrounded by and projects beyond a first main outsole surface area, wherein the forefoot projection area is connected to the first main outsole surface area by a first flexible web member, wherein the rearfoot projection area is at least partially surrounded by and projects beyond a second main outsole surface area, and wherein the rearfoot projection area is connected to the second main outsole surface area by a second flexible web member;

a midsole component engaged with the interior major surface of the outsole component, wherein the midsole component includes a forefoot opening and a rearfoot opening, wherein the forefoot opening at least partially surrounds the forefoot recessed area and the rearfoot opening at least partially surrounds the rearfoot recessed area, and wherein a top surface of the midsole component includes a recessed area that extends at least partially around the forefoot and rearfoot openings;

a forefoot fluid-filled bladder system located in the forefoot opening, wherein a perimeter edge of the forefoot fluid-filled bladder system does not contact a side edge of the forefoot opening when the forefoot fluid-filled bladder system is in an uncompressed condition, and wherein the forefoot fluid-filled bladder system has a bottom surface fixed to the interior major surface of the outsole component at the forefoot recessed area and a top surface;

a rearfoot fluid-filled bladder system located in the rearfoot opening, wherein a perimeter edge of the rearfoot fluid-filled bladder system does not contact a side edge of the rearfoot opening when the rearfoot fluid-filled bladder system is in an uncompressed condition, and wherein the rearfoot fluid-filled bladder system has a bottom surface fixed to the interior major surface of the outsole component at the rearfoot recessed area and a top surface; and a rigid plate component formed as an arched spring plate at least partially overlaying and having a bottom surface fixed to the recessed area of the top surface of the midsole component, the top surface of the forefoot fluid-filled bladder system, and the top surface of the rearfoot fluid-filled bladder system, wherein the rigid plate component is made from a rigid, non-foam plastic material, wherein the arched spring plate includes (a) a first metatarsal head support portion configured to support a first metatarsal head area of a wearer's foot, (b) a fifth metatarsal head support portion configured to support a fifth metatarsal head area of a wearer's foot, and (c) a rear heel support portion configured to support a calcaneus bone of a wearer's foot, wherein the arched spring plate is arched in at least one of a heel-to-toe direction or a medial side-to-lateral side direction of the sole structure, and wherein the arched spring plate is configured in the sole structure such that: (a) a downward force on the arched spring plate applied by a wearer's weight on the sole structure flattens out the arched spring plate and (b) when the downward force is reduced or released as the wearer's foot is lifted from a contact surface, the arched spring plate applies a rebound or return force to the wearer's foot.

3. A sole structure for an article of footwear, comprising:

an outsole component including an exterior major surface and an interior major surface, wherein the exterior major surface includes a forefoot projection area and a rearfoot projection area, wherein the forefoot projection area is at least partially surrounded by and projects beyond a first main outsole surface area, wherein the forefoot projection area is connected to the first main outsole surface area by a first flexible web member, wherein the rearfoot projection area is at least partially surrounded by and projects beyond a second main outsole surface area, and wherein the rearfoot projection area is connected to the second main outsole surface area by a second flexible web member;

a midsole component engaged with the interior major surface of the outsole component, wherein the midsole component includes a forefoot opening and a rearfoot opening, wherein the forefoot opening is located proximate to the forefoot projection area, and wherein the rearfoot opening is located proximate to the rearfoot projection area;

a forefoot fluid-filled bladder system having a bottom surface fixed to the interior major surface of the outsole component at the forefoot projection area and a top surface;

a rearfoot fluid-filled bladder system having a bottom surface fixed to the interior major surface of the outsole component at the rearfoot projection area and a top surface; and a rigid plate component formed as an arch spring plate overlaying a top surface of the midsole component, the rigid plate component having a bottom surface fixed to the top surface of the forefoot fluid-filled bladder system and to the top surface of the rearfoot fluid-filled bladder system, wherein the rigid plate component is made from a rigid, non-foam plastic material, wherein the arched spring plate includes (a) a first metatarsal head support portion configured to support a first metatarsal head area of a wearer's foot, (b) a fifth metatarsal head support portion configured to support a fifth metatarsal head area of a wearer's foot, and (c) a rear heel support portion configured to support a calcaneus bone of a wearer's foot, wherein the arched spring plate is arched in at least one of a heel-to-toe direction or a medial side-to-lateral side direction of the sole structure, and wherein the arched spring plate is configured in the sole structure such that: (a) a downward force on the arched spring plate applied by a wearer's weight on the sole structure flattens out the arched spring plate and (b) when the downward force is reduced or released as the wearer's foot is lifted from a contact surface, the arched spring plate applies a rebound or return force to the wearer's foot.

4. A sole structure according to claim 3, wherein the forefoot fluid-filled bladder system includes a single fluid-filled bladder.

5. A sole structure according to claim 3, wherein the rearfoot fluid-filled bladder system includes a single fluid-filled bladder.

6. A sole structure according to claim 3, wherein the rearfoot fluid-filled bladder system includes two fluid-filled bladders.

7. A sole structure according to claim 3, wherein the rearfoot fluid-filled bladder system includes two stacked fluid-filled bladders.

8. A sole structure according to claim 3, wherein the rigid plate component constitutes a single, continuous plate member that extends from the rear heel support portion to a first location located beyond the first metatarsal head support portion and to a second location located beyond the fifth metatarsal head support portion.

9. A sole structure according to claim 3, wherein the forefoot fluid-filled bladder system is adapted to support a first metatarsal head region of a wearer's foot and a fifth metatarsal head region of the wearer's foot, and wherein the rigid plate component constitutes a single, continuous plate member that extends from the rear heel support portion to a first location beyond the first metatarsal head support portion and to a second location beyond the fifth metatarsal head support portion.

10. A sole structure according to claim 3, wherein the forefoot fluid-filled bladder system has a maximum thickness when inflated of 0.5 inches or less, and wherein the rearfoot fluid-filled bladder system has a maximum thickness when inflated of 0.75 inches or less.

11. A sole structure according to claim 3, wherein the rearfoot fluid-filled bladder system includes two stacked fluid-filled bladders that have a combined maximum thickness when inflated of 0.75 inches or less.

12. A sole structure according to claim 3, wherein the first main outsole surface area completely surrounds the forefoot projection area, and wherein the second main outsole surface area completely surrounds the rearfoot projection area.

13. A sole structure according to claim 3, wherein the forefoot opening of the midsole component completely surrounds the forefoot fluid-filled bladder system, and wherein the rearfoot opening of the midsole component completely surrounds the rearfoot fluid-filled bladder system.

14. A sole structure according to claim 3, wherein the rigid plate component completely covers the forefoot fluid-filled bladder system and the rearfoot fluid-filled bladder system.

15. A sole structure according to claim 1, wherein the rigid, non-foam plastic material forming the arched spring plate is a material having a hardness of 50 to 80 Shore D.

16. A sole structure according to claim 1, wherein the rigid, non-foam plastic material forming the arched spring plate has a thickness from ⅛ inch to ⅜ inch thick and is a material selected from the group consisting of: a non-foam plastic material including fiber reinforcement; a carbon fiber composite material; a fiberglass material; and a polyether block amide material.

17. A sole structure according to claim 2, wherein the rigid, non-foam plastic material is a material having a hardness of 50 to 80 Shore D.

18. A sole structure according to claim 2, wherein the rigid, non-foam plastic material has a thickness from ⅛ inch to ⅜ inch thick and is a material selected from the group consisting of: a non-foam plastic material including fiber reinforcement; a carbon fiber composite material; a fiberglass material; and a polyether block amide material.

19. A sole structure according to claim 3, wherein the rigid, non-foam plastic material is a material having a hardness of 50 to 80 Shore D.

20. A sole structure according to claim 3, wherein the rigid, non-foam plastic material has a thickness from ⅛ inch to ⅜ inch thick and is a material selected from the group consisting of: a non-foam plastic material including fiber reinforcement; a carbon fiber composite material; a fiberglass material; and a polyether block amide material.

* * * * *